US009560439B2

(12) United States Patent
Mehra et al.

(10) Patent No.: US 9,560,439 B2
(45) Date of Patent: Jan. 31, 2017

(54) METHODS, SYSTEMS, AND COMPUTER READABLE MEDIA FOR SOURCE AND LISTENER DIRECTIVITY FOR INTERACTIVE WAVE-BASED SOUND PROPAGATION

(71) Applicant: The University of North Carolina at Chapel Hill, Chapel Hill, NC (US)

(72) Inventors: Ravish Mehra, Chapel Hill, NC (US); Lakulish Shailesh Antani, Chapel Hill, NC (US); Dinesh Manocha, Chapel Hill, NC (US)

(73) Assignee: The University of North Carolina at Chapel Hills, Chapel Hill, NC (US)

( * ) Notice: Subject to any disclaimer, the term of this patent is extended or adjusted under 35 U.S.C. 154(b) by 231 days.

(21) Appl. No.: 14/318,916

(22) Filed: Jun. 30, 2014

(65) Prior Publication Data

US 2015/0326966 A1 Nov. 12, 2015

Related U.S. Application Data

(60) Provisional application No. 61/841,910, filed on Jul. 1, 2013.

(51) Int. Cl.
*H04R 1/20* (2006.01)

(52) U.S. Cl.
CPC ..... *H04R 1/20* (2013.01)

(58) Field of Classification Search
CPC ..... H04R 1/20
See application file for complete search history.

(56) References Cited

U.S. PATENT DOCUMENTS

| | | | | |
|---|---|---|---|---|
| 7,643,377 | B1 * | 1/2010 | Uzes | G01S 3/04 367/135 |
| 2007/0036432 | A1 | 2/2007 | Xu et al. | |
| 2009/0262604 | A1 | 10/2009 | Funada | |
| 2011/0017545 | A1 | 1/2011 | Pompei | |
| 2012/0007940 | A1 | 1/2012 | Michrowski et al. | |
| 2012/0016640 | A1 | 1/2012 | Murphy | |
| 2015/0057083 | A1 | 2/2015 | Mehra et al. | |
| 2015/0294041 | A1 * | 10/2015 | Yeh | G06F 17/5009 703/2 |

(Continued)

FOREIGN PATENT DOCUMENTS

WO WO 2013/184215 A2 12/2013

OTHER PUBLICATIONS

Ahrens, J., and Spors, S. 2012. Wave field synthesis of a sound field described by spherical harmonics expansion coefficients. The Journal of the Acoustical Society of America 131, 3, 2190-2199.*

(Continued)

*Primary Examiner* — Daniel Pihulic
(74) *Attorney, Agent, or Firm* — Jenkins, Wilson, Taylor & Hunt, P.A.

(57) ABSTRACT

Methods, systems, and computer readable media for supporting source or listener directivity in a wave-based sound propagation model are disclosed. According to one method, the method includes computing, prior to run-time, one or more sound fields associated with a source or listener position and modeling, at run-time and using the one or more sound fields and a wave-based sound propagation model, source or listener directivity in an environment.

23 Claims, 8 Drawing Sheets

(56) References Cited

U.S. PATENT DOCUMENTS

2015/0326966 A1* 11/2015 Mehra ..... H04R 1/20
367/138

OTHER PUBLICATIONS

Duraiswami, R., Zotkin, D. N., Li, Z., Grassi, E., Gumerov, N. A., and Davis, L. S. 2005. High order spatial audio capture and binaural head-tracked playback over headphones with hrtf cues. In 119th AES Convention, 16 pages.*
Svenson, "Software and measurement data for download," http://www.iet.ntnu.no/~svensson/software/index.html#EDGE (Jun. 30, 2015).
"Interactive 3D Audio Rendering Guidelines—Level 2.0," Interactive Audio Special Interest Group, pp. 1-29 (Sep. 20, 1999).
Abramowitz et al, "Handbook of Mathematical Functions," 5th ed. Dover, New York (1964).
Ahrens, "Wave Field Synthesis of a Sound Field Described by Spherical Harmonics Expansion Coefficients," The Journal of the Acoustical Society of America, vol. 131, No. 3, pp. 2190-2199 (Mar. 2012).
Algazi et al., "The CIPIC HRTF Database," Applications of Signal Processing to Audio and Acoustics, 2001 IEEE Workshop, pp. 99-102 (Oct. 21-24, 2001).
Allen et al., "Image Method of Efficently Simulating Small-Room Acoustics," The Journal of the Acoustical Society of America, vol. 65, No. 4, pp. 943-950 (Apr. 1979).
Antani et al., "Direct-to-Indirect Acoustic Radiance Transfer," IEEE Transactions on Visualization and Computer Graphics, vol. 18, No. 2, pp. 261-269 (Feb. 2012).
Antani et al., "Interactive Sound Propagation Using Compact Acoustic Transfer Operators," ACM Transactions on Graphics, vol. 31, No. 1, Article 7, pp. 7:1-7:12 (Jan. 2012).
Aretz, "Combined Wave and Ray Based Room Acoustic Simulations of Small Rooms," vol. 25, pp. 1-229 (Sep. 2012).
Barbone et al., "Scattering by a Hybrid Asymptotic/Finite Element Method," Methods in Applied Mechanics and Engineering, vol. 164, pp. 141-156 (1998).
Begault, "3-D Sound for Virtual Reality and Multimedia," pp. 1-246 (Apr. 2000).
Ben-Artzi et al., "A Precomputed Polynomial Representation for Interactive BRDF Editing with Global Illumination," ACM Transactions on Graphics, vol. 27, No. 2 (2008).
Blauert, "Spatial Hearing: The Pscychophysics of Human Sound Localization," MIT Press (1983).
Boyd. "Chebyshev and Fourier Spectral Methods: Second Revised Edition," 2 revised ed. Dover Publications (Dec. 2001).
Calamia et al., "Fast Time-Domain Edge-Diffraction Calculations for Interactive Acoustic Simulations," EURASIP Journal on Advances in Signal Processing, vol. 2007, pp. 1-10 (2007).
Chadwick et al., "Harmonic Shells: A Practical Nonlinear Sound Model for Near-Rigid Thin Shells," ACM SIGGRAPH Asia 2009 papers, pp. 119:1-119:10 (2009).
Cheng et al., "Heritage and Early History of the Boundary Element Method," Engineering Analysis with Boundary Elements, vol. 29, No. 3, pp. 268-302 (Mar. 2005).
CLF, "CLF: Common Loudspeaker Format," (date last viewed Oct. 21, 2012). http://www.clfgroup.org/.
Doicu et al., "Acoustic and Electromagnetic Scattering Analysis Using Discrete Sources," 1st ed. Academic Press (Jul. 2000).
Duraiswami et al., "High Order Spatial Audio Capture and its Binaural Head-Tracked Playback over Headphones with HRTF Cues," 119th Audio Engineering Society Convention, pp. 1-16 (Oct. 7-10, 2005).
Fairweather et al., "The Method of Fundamental Solutions for Scattering and Radiation Problems," Engineering Analysis with Boundary Elements, vol. 27, No. 7, pp. 759-769 (Jul. 2003).
FastBEM Acoustics, www.fastbem.com, Advanced CAE Research, LLC, Cincinnati, Ohio (2007-2015).
Funkhouser et al., "A Beam Tracing Approach to Acoustic Modeling for Interactive Virtual Environments," ACM SIGGRAPH, pp. 21-32 (1998).
Funkhouser et al., "Survey of Methods for Modeling Sound Propagation in Interactive Virtual Environment Systems," Presence and Teleoperation, pp. 1-53 (2003).
Giron, "Investigations about the Directivity of Sound Sources: Dissertation," Berichte aus der Elektrotechnik. Shaker (1996).
Green, "Spherical Harmonic Lighting: The Gritty Details," Archives of the Game Developers Conference, pp. 1-47 (Jan. 16, 2003).
Gumerov et al., "A Broadband Fast Multipole Accelerated Boundary Element Method for the Three Dimensional Helmholtz Equation," The Journal of the Acoustical Society of America. vol. 125, No. 1, pp. 191-205 (Jan. 2009).
Hacihabiboğlu et al. "Time-Domain Simulation of Directive Sources in 3-D Digital Waveguide Mesh-Based Acoustical Models," IEEE Transactions on Audio, Speech, and Language Processing, vol. 16, No. 5, pp. 934-946 (Jul. 2008).
Hampel et al., "Coupling Boundary Elements to a Raytracing Procedure," International Journal for the Numerical Methods in Engineering, pp. 427-445 (2008).
IASIG, "Interactive audio special interest group : Interactive 3d audio rendering guidelines, level 2.0," (1999).
James et al., "Precomputed Acoustic Transfer: Output-Sensitive, Accurate Sound Generation for Geometrically Complex Vibration Sources," ACM SIGGRAPH, vol. 25, No. 3, pp. 987-995 (Jul. 2006).
Jean et al., "Calculation of Tyre Noise Radiation with a Mixed Approach," pp. 1-6 (2008).
Kino, "Acoustic Waves: Devices, Imaging, and Analog Signal Processing," Prentice Hall Signalling Processing Series, pp. 1-625 (1987).
Kouyoumjian et al., "A Uniform Geometrical Theory of Diffusion for an Edge in a Perfectly Conducting Surface," Proceedings of the IEEE, vol. 62, No. 11, pp. 1448-1461 (Nov. 1974).
Lentz et al., "Virtual Reality System with Integrated Sound Field Simulation and Reproduction," EURASIP Journal on Advances in Signal Processing, vol. 2007, pp. 1-19 (2007).
Liu et al., "Development of the Fast Multipole Boundary Element Method for Acoustic Wave Problems," Recent Advances in Boundary Element Methods, pp. 287-303 (2009).
Liu, "Fast Mutlipole Boundary Element Method: Theory and Applications in Engineering," Cambridge, pp. 119:1-119:10 (2009).
Lokki et al., "Studies of Epidaurus with a Hybrid Room Acoustics Modelling Method," The Acoustics of Ancient Theatres Conference, Patras, pp. 1-6 (Sep. 18-21, 2011).
Malham, "Higher Order Ambisonic Systems for the Spatialization of Sound," ICMC Proceedings, pp. 484-487 (1999).
Mehra, "Wave-Based Sound Propagation in Large Open Scenes using an Equivalent Source Formulation," ACM Transactions on Graphics, vol. 32, No. 2, pp. 1-13 (Apr. 2013).
Menzies et al., "Ambisonic Synthesis of Complex Sources," J. Audio Eng. Soc. vol. 55, No. 10, pp. 864-876 (2007).
Meyer et al., "Acoustics and the Performance of Music", Manual for Acousticians, Audio Engineers, Musicians, Architects and Musical Instruments Makers, pp. 1-447 (2009).
Meyer, "A Highly Scalable Spherical Microphone Array Based on an Orthonormal Decomposition of the Soundfield," ICASSP, vol. 2, pp. II-1781-II-1784 (2002).
Murphy et al, "Hybrid Room Impulse Response Synthesis in Digital Waveguide Mesh Based Room Acoustics Simulation," Proc. of the 11th Conference on Digital Audio Effects, DAFx-08, Espoo, Finland, pp. 1-8 (Sep. 1-4, 2008).
Notification of Transmittal of the International Search Report and the Written Opinion of the International Searching Authority, or the Declaration for International Application No. PCT/US2013/031619 (Dec. 24, 2013).
Otondo et al., "The Influence of the Directivity of Musical Instruments in a Room," Acta Acustica United with Acustica, vol. 90, No. 6, pp. 1178-1184 (2004).
Petzer et al., "Auralization of a Virtual Orchestra Using Directivities of Measured Virtual Orchestra Using Directivites of Measured

(56) References Cited

OTHER PUBLICATIONS

Symphonic Instruments," Proceedings of the Acoustics 2012 Nantes Conference, pp. 2379-2384 (Apr. 23-27, 2012).
Pierce, "Acoustics: An Introduction to Its Physical Principles and Applications," Acoustical Society of America (1989).
Rafaely et al., "Interaural Cross Correlation in a Sound Field Represented by Spherical Harmonics," The Journal of the Acoustical Society of America, vol. 127, No. 2, pp. 823-828 (Feb. 2010).
Raghuvanshi et al., "Efficient and Accurate Sound Propagation Using Adaptive Rectangular Decomposition," IEEE Transactions on Visualization and Computer Graphics, vol. 15, No. 5, pp. 789-801 (2009).
Raghuvanshi et al., "Precomputed Wave Simulation for Real-Time Sound Propagation of Dynamic Sources in Complex Scenes," SIGGRAPH, vol. 29, No. 3, pp. 1-11 (Jul. 2010).
Savioja, "Real-Time 3D Finite-Difference Time-Domain Simulation of Mid-Frequency Room Acoustics," 13th International Conference on Digital Audio Effects, DAFx-10 (2010).
Siltanen et al., "The Room Acoustic Rendering Equation," The Journal of the Acoustical Society of America, vol. 122, No. 3, pp. 1624-1635 (Sep. 2007).
Svensson et al., "An Analytic Secondary Source Model of Edge Diffraction Impulse Responses," The Journal of the Acoustical Society of America, vol. 106, No. 5, pp. 2331-2344 (Nov. 1999).
Taflove et al, "Computational Electrodynamics: Tire Finite-Difference Time-Domain Method, Third Edition," 3rd ed. Artech House Publishers, London, UK and Boston, USA, ch. 1,4 (Jun. 2005).
Taylor et al, "Guided Multiview Ray Tracing for Fast Auralization," IEEE Transactions on Visualization and Computer Graphics, vol. 18, No. 11, pp. 1797-1810 (Nov. 2012).
Taylor et al., "RESound: Interactive Sound Rendering for Dynamic Virtual Environments," MM'09 Proceedings of the Seventeen ACM International Conference on Multimedia, pp. 271-280 (2009).
Thompson, "A Review of Finite-Element Methods for Time-Harmonic Accoustics," The Journal of the Acoustical Society of America, vol. 119, No. 3, pp. 1315-1330 (Mar. 2006).
Tsingos, "A General Model for the Simulation of Room Acoustics Based on Hierarchical Radiosity," ACM SIGGRAPH, pp. 1-10 (1997).
Tsingos et al., "Instant Sound Scattering," Eurographics Symposium on Rendering, pp. 1-10 (2007).
Tsingos et al., "Modeling Acoustics in Virtual Environments Using the Uniform Theory of Diffraction," SIGGRAPH '01, ACM, pp. 1-9 (2001).
Tsingos, "Pre-Computing Geometry-Based Reverberation Effects for Games," 35th AES Conference on Audio for Games, pp. 1-10 (Feb. 11-13, 2009).
Vigeant, "Investigations of Incorporating Source Directivity into Room Acoustics Computer Models to Improve Auralizations," The Journal of the Acoustical Society of America, vol. 124, No. 5, pp. 2664-2664 (2008).
Vorländer, "Simulation of the Transient and Steady-State Sound Propagation in Rooms Using a New Combined Ray-Tracing/Image-Source Algorithm," The Journal of the Acoustical Society of America, vol. 86, No. 1, pp. 172-178 (Jul. 1989).
Wang et al, "A Hybrid Technique Based on Combining Ray Tracing and FDTD Methods for Site-Specific Modeling of Indoor Radio Wave Propagation," IEEE Transactions on Antennas and Propagation, vol. 48, No. 5, pp. 743-754 (May 2000).
Ward et al., "Reproduction of a Plane-Wave Sound Field Using an Array of Loudspeakers," IEEE Transactions on Speech and Audio Processing, vol. 9, No. 6, pp. 697-707 (Sep. 2001).
Waterman, "T-matrix Methods in Acoustic Scattering," The Journal of the Acoustical Society of America, vol. 125, No. 1, pp. 42-51 (Jan. 2009).
Yee, "Numerical Solution of Initial Boundary Value Problems Involving Maxwell's Equations in Isotropic Media, " IEEE Transactions on Antennas and Propagation, vol. 14, No. 3, pp. 302-307 (May 1966).
Zheng et al., "Harmonic Fluids," ACM SIGGRAPH 2009 papers, pp. 37:1-37:12 (2009).
Zheng et al., "Rigid-Body Fracture Sound with Precomputed Soundbanks," ACM SIGGRAPH, pp. 69:1-69:13 (2010).
Zienkiewicz et al., "The Finite Element Method for Fluid Dynamics," 6 ed. Butterworth-Heinemann (Jan. 2006).
Zotkin et al., "Plane-Wave Decomposition of Acoustical Scenes Via Spherical and Cylindrical Microphone Arrays," IEEE Transactions on Audio, Speech, and Language Processing, vol. 18, No. 1, pp. 2-16 (Jan. 2010).
Albert et al., "The Effect of Buildings on Acoustic Pulse Propagation in an Urban Enviroment," Journal of the Acoustical Society of America, vol. 127 (2010).
Jers, "Directivity of singers," The Journal of the Acoustical Society of America, vol. 118, No. 3, pp. 2008-2008 (2005).
Kropp et al, "Application of the Time Domain Firmulation of the Method of Equivalent Sources to Radiation and Scattering Problems," Acta Acustica united with Acustica, vol. 81, No. 6, pp. 528-543 (1995).
Liu, "The PTSD Algorithm: A Time-Domain Method Combining the Pseudospectral Technique and Perfectly Matched Layers," The Journal of the Acoustical Society of America, vol. 101, No. 5, p. 3182 (1997).
Ochmann, "The Full-Fled Equations for Acoustic Radiation and Scattering," The Journal of the Acoustical Society of America, vol. 105, No. 5, pp. 2574-2584 (1999).
Ochmann, "The Source Simulation Technique for Acoustic Radiation Problems," Acustica, vol. 81, pp. 512-527 (1995).
Pavic, "A Technique for the Computation of Sound Radiation by Vibrating Bodies Using Substitute Sources," Acta Acustica united with Acustica, vol. 92, pp. 112-126 (2006).
Sakamoto et al, "Numerical Analysis of Sound Propagation in Rooms Using the Finite Difference Time Domain Method," The Journal of the Acousitcal Society of America, vol. 120, No. 5, p. 3008 (2006).
Southern et al, "Low Complexity Directional Sound Sources for Finite Difference Time Domain Room Acoustic Models," Audio Engineering Society Convention, vol. 126 (2009).

* cited by examiner

METHODS, SYSTEMS, AND COMPUTER READABLE MEDIA FOR SOURCE AND LISTENER DIRECTIVITY FOR INTERACTIVE WAVE-BASED SOUND PROPAGATION

PRIORITY CLAIM

This application claims the benefit of U.S. Provisional Patent Application Ser. No. 61/841,910, filed Jul. 1, 2013; the disclosure of which is incorporated herein by reference in its entirety.

GOVERNMENT INTEREST

This invention was made with government support under Grant Nos. IIS-0917040, CMMI-1000579, and 0904990 awarded by the National Science Foundation and W911NF-10-1-0506 awarded by the Army Research Office. The government has certain rights in the invention.

TECHNICAL FIELD

The subject matter described herein relates to sound propagation. More specifically, the subject matter relates to methods, systems, and computer readable media for supporting source or listener directivity in a wave-based sound propagation model.

BACKGROUND

Sound propagation techniques determine how sound waves travel in a space and interact with the environment. In many applications, it is important to be able to simulate sound propagation in large scenes, such as games and training in both indoor and outdoor scenes, noise prediction in urban areas, and architectural acoustics design for buildings and interior spaces such as concert halls. Realistic acoustic effects can also improve the realism of a virtual environment. Acoustic phenomena such as interference, diffraction, and scattering for general scenes can only be captured by accurately solving the acoustic wave equation. The large spatial and frequency domain and accuracy requirement pose a significant challenge for acoustic techniques to be used in these diverse domains with different requirements.

Sound sources can be omnidirectional (e.g., radiating sound isotropically) or directional (e.g., radiating sound anisotropically). Most sound sources we come across in real life (e.g., ranging from human voices through speaker systems in televisions, radio, smartphones, machine noises in cars, aircrafts, helicopters, and musical instruments) are directional sources that have a specific directivity pattern. This directivity depends on the shape, size, and material properties of the sound source, as well as a complex interaction of the processes of vibration and sound radiation, resulting in varying directivity at different frequencies. Due to the non-uniform radiation of sound, directional sources have a significant impact on sound propagation and the corresponding acoustic response of the environments. Acoustic effects generated from directional sources are noticeable in everyday life: a person talking towards/away from a listener, positioning of different types of musical instruments in an orchestra, good-sounding places (sweet spots) in front of television in the living room, aircraft, helicopter, or fire trucks in an urban environment.

Analogous to source directivities, listeners also have directivities. In other words, listeners do not receive sound in the same way from all directions. The human auditory system obtains significant directional cues from the subtle differences in sound received by each ear which are caused by the scattering of sound around the head. Listener directivity can be used to enhance a user's immersion in a virtual environment by providing the listener with cues corresponding to the directions the sound is coming from, and thereby enriching the experience.

Various techniques may be used in predicting or modeling sound propagation. Some techniques may involve assuming sound travels like rays (e.g., beams of lights). Other techniques may involve assuming sound travels like waves. However, current techniques are unable to efficiently support source or listener directivity in an interactive wave-based sound propagation model.

Accordingly, there exists a need for methods, systems, and computer readable media for supporting source or listener directivity in an interactive wave-based sound propagation model.

SUMMARY

Methods, systems, and computer readable media for supporting source or listener directivity in a wave-based sound propagation model are disclosed. According to one method, the method includes computing, prior to run-time, one or more sound fields associated with a source or listener position and modeling, at run-time and using the one or more sound fields and a wave-based sound propagation model, source or listener directivity in an environment.

A system for supporting source or listener directivity in a wave-based sound propagation model is also disclosed. The system includes a processor and a sound propagation model (SPM) module executable by the processor. The SPM module is configured to compute, prior to run-time, one or more sound fields associated with a source or listener position and to model, at run-time and using the one or more sound fields and a wave-based sound propagation model, source or listener directivity in an environment.

The subject matter described herein can be implemented in software in combination with hardware and/or firmware. For example, the subject matter described herein can be implemented in software executed by a processor. In one exemplary implementation, the subject matter described herein may be implemented using a computer readable medium having stored thereon computer executable instructions that when executed by the processor of a computer control the computer to perform steps. Exemplary computer readable media suitable for implementing the subject matter described herein include non-transitory devices, such as disk memory devices, chip memory devices, programmable logic devices, and application specific integrated circuits. In addition, a computer readable medium that implements the subject matter described herein may be located on a single device or computing platform or may be distributed across multiple devices or computing platforms.

As used herein, the terms "node" and "host" refer to a physical computing platform or device including one or more processors and memory.

As used herein, the term "module" refers to hardware, firmware, or software in combination with hardware and/or firmware for implementing features described herein.

BRIEF DESCRIPTION OF THE DRAWINGS

Preferred embodiments of the subject matter described herein will now be explained with reference to the accompanying drawing, wherein like reference numerals represent like parts, of which.

DETAILED DESCRIPTION

The subject matter described herein discloses methods, systems, and computer readable media for supporting source or listener directivity in a wave-based sound propagation model. In accordance with some aspects of the present subject matter described herein, exemplary mechanisms, processes, or systems may be provided or supported for modeling time-varying, data-driven, or arbitrary source directivity and head-related transfer function (HRTF)-based listener directivity for interactive wave-based sound propagation in frequency domain. For example, a sound propagation modeling or simulation application in accordance with some aspects of the present subject matter described herein may support time-varying, data-driven source directivity based on spherical harmonic (SH) basis, where the source directivity can be dynamically modified at run-time. In some embodiments, the propagated sound fields due to SH sources may be precomputed, stored, and used to compute the total sound field at run-time.

In accordance with some aspects of the present subject matter described herein, an exemplary sound propagation modeling or simulation application may support a plane-wave decomposition based on pressure derivatives for modeling HRTF-based listener directivity to generate spatial sound in interactive applications, where the plane-wave decomposition may be performed in real-time compared to prior plane-wave decomposition methods which are offline.

In accordance with some aspects of the present subject matter described herein, an exemplary sound propagation modeling or simulation application may accurately simulate sound fields that include wave-phenomena such as scattering and diffraction and can also produce spatial sound cues that provide localization and immersion for interactive applications.

In accordance with some aspects of the present subject matter described herein, a general framework may be provided for integrating source and/or listener directivities in any offline or online frequency domain wave-based propagation algorithm (e.g., a boundary element method or an interactive equivalent sources method).

In accordance with some aspects of the present subject matter described herein, a real-time and/or memory efficient sound rendering system may use aspects described herein to provide realistic acoustic effects from directional sources and spatial sound in interactive applications.

Reference will now be made in detail to exemplary embodiments of the subject matter described herein, examples of which are illustrated in the accompanying drawing. Wherever possible, the same reference numbers will be used throughout the drawings to refer to the same or like parts.

Figure 1:
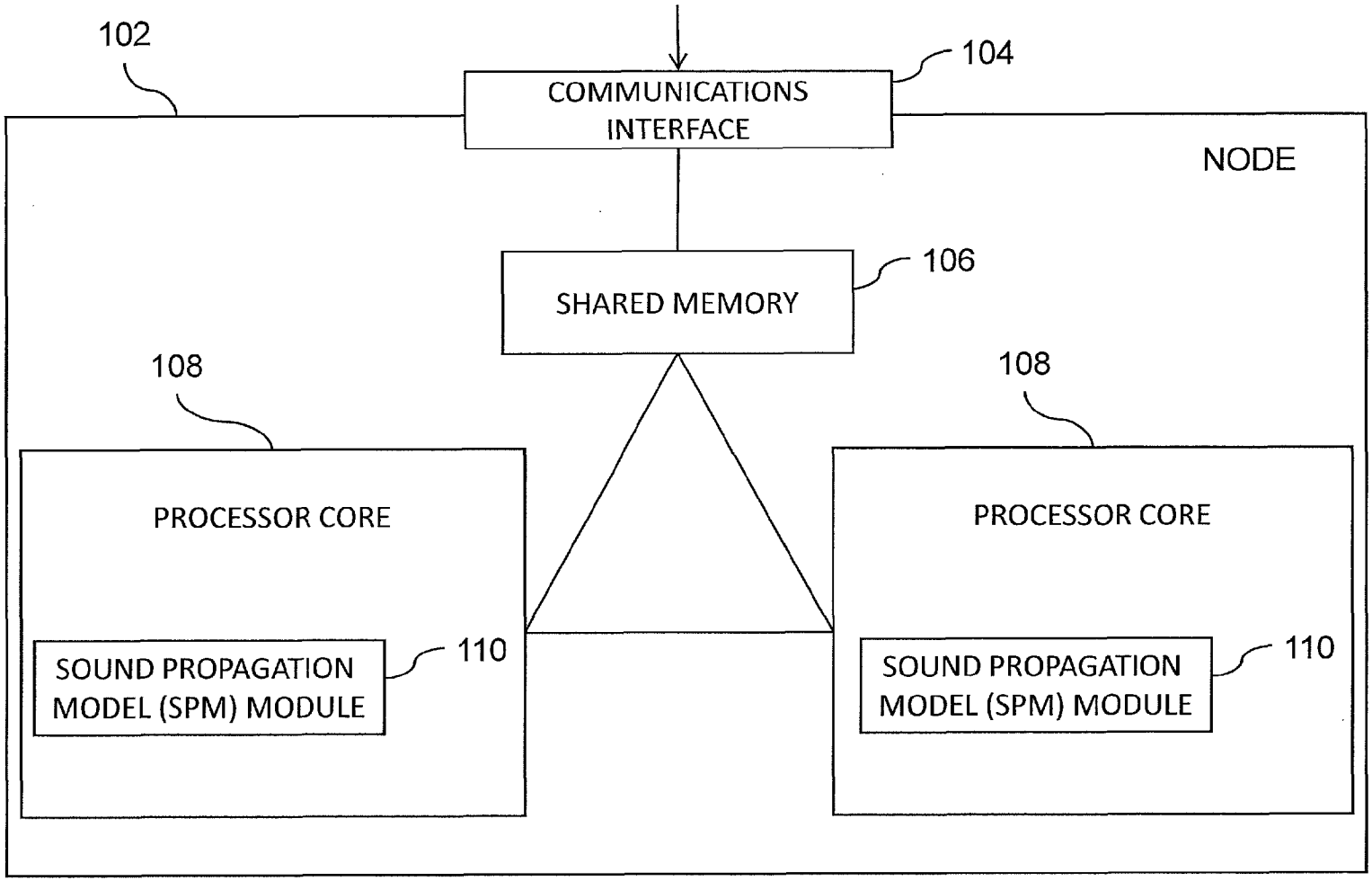
FIG. 1 is a diagram illustrating an exemplary node for supporting source and/or listener directivity in a wave-based sound propagation model according to an embodiment of the subject matter described herein.

FIG. 1 is a diagram illustrating an exemplary node 102 (e.g., a single or multiple processing core computing device) for supporting source and/or listener directivity in a wave-based sound propagation model according to an embodiment of the subject matter described herein. Node 102 may be any suitable entity, such as a computing device or platform, for performing one more aspects of the present subject matter described herein or in the attached manuscript entitled "Source and Listener Directivity for Interactive Wave-based Sound Propagation" and related manuscript entitled "Supplementary text: Source and Listener Directivity for Interactive Wave-based Sound Propagation;" the disclosures of the attached manuscripts are incorporated herein by reference in their entireties. In some embodiments, components, modules, and/or portions of node 102 may be implemented or distributed across multiple devices or computing platforms.

Node 102 may include a communications interface 104, a shared memory 106, and one or more processor cores 108. Communications interface 104 may be any suitable entity (e.g., a communications interface and/or a data acquisition and generation (DAG) card) for receiving and/or sending messages. For example, communications interface 104 may be interface between various nodes 102 in a computing cluster. In another example, communications interface 104 may be associated with a user interface or other entity and may receive configuration setting and/or source data, such as audio information, for processing during a sound propagation model application.

In some embodiments, communications interface 104 or another component may be configured to identify or select a processor core 108 for processing or analysis and/or information for storage. For example, communications interface 104 may receive information from another node in a cluster and may determine that a particular processor core 108 should process the received information. In another example, communications interface 104 may store information in shared memory 106 and the stored information may be retrieved later by an available processor core 108. Shared memory 106 may be any suitable entity (e.g., random access memory or flash memory) for storing sound propagation information, such as sound field data, pressure derivatives, plane-wave decomposition information, SH information, source audio information, and/or other information. Various components, such as communications interface 104 and software executing on processor cores 108, may access (e.g., read from and/or write to) shared memory 106.

Each of processor cores 108 represents any suitable entity (e.g., a physical processor, a field-programmable gateway array (FPGA), and/or an application-specific integrated circuit (ASIC)) for performing one or more functions associated with sound propagation modeling. Processor cores 108 may be associated with a sound propagation model (SPM)

module 110. For example, SPM module 110 or software therein may be executable by one or more processor cores 108.

SPM module 110 may be configured to use one or more techniques (e.g., geometric acoustic techniques and/or numerical acoustic techniques) for modeling sound propagation in one or more environments. Existing techniques for modeling sound propagation can be broadly classified into geometric and wave-based techniques. Geometric techniques can handle arbitrary source and listener directivity for offline and interactive applications. However, due to their inherent assumption of rectilinear propagation of sound, modeling wave effects like diffraction and interference, using geometric techniques remains a significant challenge, especially at low frequencies. This becomes a limiting factor for simulating sources that have prominent directivity patterns at low frequencies (e.g. human voices).

In contrast with geometric techniques, wave-based techniques can accurately perform sound propagation at low frequencies, but their computational complexity increases significantly for high frequencies. There has been considerable interest in recent years in developing interactive wave-based sound propagation techniques for computer graphics. Current techniques for interactive applications have a high precomputation overhead and can only model source directivity during the offline computation. As a result, the source directivity is hard-coded into the final solution, and it is not possible to modify the directivity pattern at run-time for interactive applications (e.g., for a rotating siren, a person covering his/her mouth, etc.). Additionally, integrating listener directivity into wave-based techniques requires a plane-wave decomposition of the sound field, which is computationally expensive for interactive applications.

In some embodiments, SPM module 110 may be configured to support source and/or listener directivity for interactive wave-based sound propagation modeling. For example, SPM module 110 may be configured to model, using precomputed sound fields, sound propagation where a sound source's directivity can be dynamically modified during run-time, e.g., a moving ambulance with siren controlled by a user during a video game. In another example, SPM module 110 may be configured to model, using precomputed sound fields and related derivative values, sound propagation where a listener's directivity can be dynamically modified during run-time, e.g., a character controlled by a user moving through a virtual environment.

In some embodiments, SPM module 110 may be configured to precompute (e.g., prior to run-time or executing of a sound propagation model application) and store propagated sound fields or pressure fields due to spherical harmonic (SH) sources. Using these precomputed sound fields, SPM module 110 may compute a total sound field using a wave-based sound propagation technique at run-time, thereby allowing modeling of a source with a directivity that can be dynamically modified at run-time.

In some embodiments, a pressure field of an entire domain may be expressed to any order of accuracy by using pressure and its higher order derivatives at a single point.

In some embodiments, plane wave decomposition of a pressure field may be computed to any order of accuracy using pressure derivatives and SH decomposition. Computing plane wave decomposition of a pressure field using pressure derivatives and SH decomposition may be significantly faster and more memory efficient than conventional methods thereby allowing computation of spatial sound at run-time.

In some embodiments, SPM module 110 may be configured to compute listener directivity for any frequency-domain, wave-based sound propagation technique. For example, an exemplary method for computing listener directivity may include computing a plane-wave decomposition of the sound field around the listener, expressing plane-wave coefficients associated with the plane-wave decomposition in terms of an SH basis, and using pressure and its derivatives at a listener position to compute corresponding SH coefficients. The HRTF may also be expressed in the SH basis. At run-time, spatial sound may be computed as a dot product between the SH coefficients of the sound field and the HRTF. By computing a plane-wave decomposition using pressure and pressure derivatives, spatial sound may be modeled or simulated in real-time. In contrast, current plane-wave decomposition methods are performed offline.

In some embodiments, SPM module 110 may be configured to work in parallel with a plurality of processor cores 108 and/or nodes 102. For example, a plurality of processor cores 108 may each be associated with a SPM module 110. In this example, each processor core 108 may perform processing associated with modeling sound propagation for a particular environment. In another example, some nodes 102 and/or processing cores 108 may be utilized for precomputing (e.g., computing pressure or sounds fields due to SH sources) and other nodes 102 and/or processing cores 108 may be utilized during run-time, e.g., to execute a sound propagation model application that utilizes precomputed values or functions.

In some embodiments, SPM module 110 may be configured to perform sound propagation modeling using any wave-based sound propagation technique, such as any technique that numerically solve or attempt to solve the acoustic wave equation. Exemplary wave-based sound propagation techniques usable by SPM module 110 may include a finite element method, a boundary element method, an equivalent source method, various spectral methods, or another frequency-domain wave-based technique.

It will be appreciated that FIG. 1 is for illustrative purposes and that various nodes, their locations, and/or their functions may be changed, altered, added, or removed. For example, some nodes and/or functions may be combined into a single entity. In a second example, a node and/or function may be located at or implemented by two or more nodes.

Figure 2:
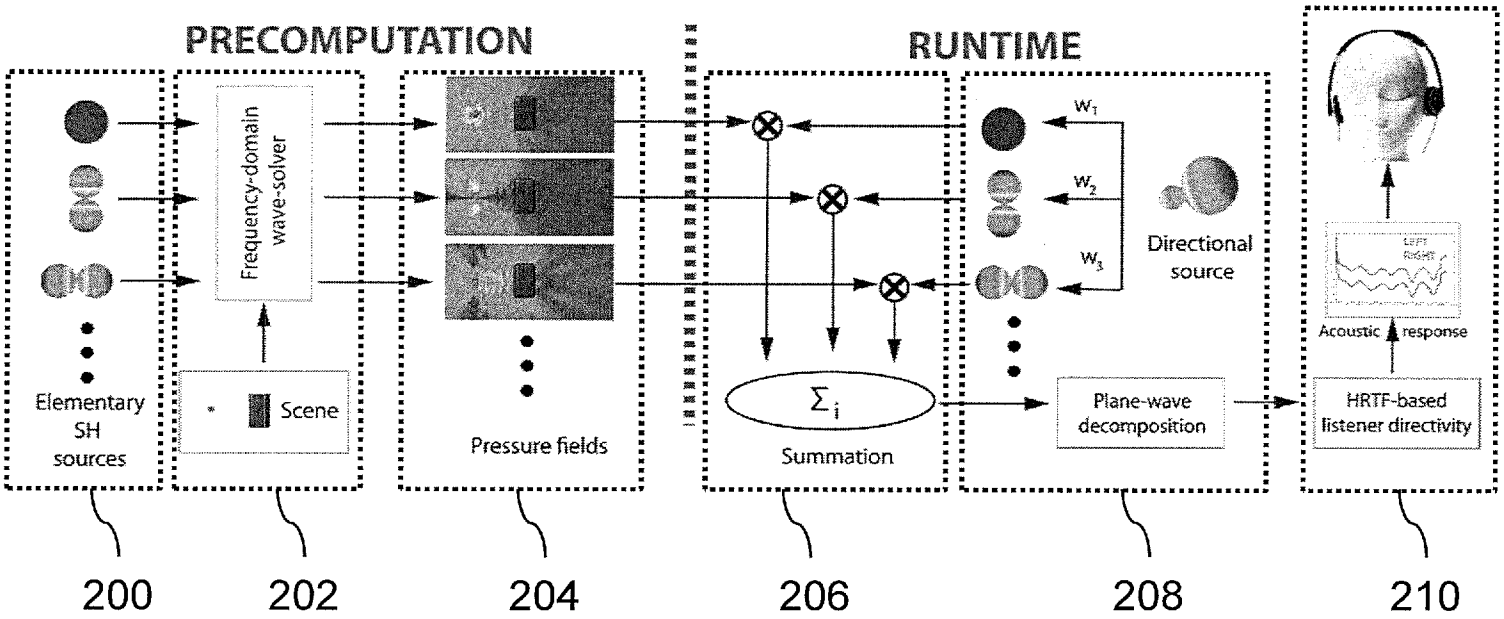
FIG. 2 is a diagram illustrating an exemplary process for computing propagated sound at a listener according to an embodiment of the subject matter described herein.

FIG. 2 is a diagram illustrating an exemplary process 200 for computing propagated sound at a listener according to an embodiment of the subject matter described herein. Referring to FIG. 2, at step 202, given a scene and a source position, a set of pressure fields due to elementary SH sources using a frequency-domain wave-based sound propagation technique are computed.

At step 204, these pressure fields are encoded in basis functions (e.g. multipoles) and stored for runtime use.

At runtime, given a dynamic source directivity, a SH decomposition of its directivity is performed to compute the corresponding SH coefficients.

At step 206, the final pressure field is computed as a summation of the pressure fields due to SH sources evaluated at the listener position weighted by the appropriate SH coefficients.

At step 208, in order to incorporate dynamic listener directivity in wave-based techniques, an interactive plane-wave decomposition approach based on derivatives of the pressure field is utilized.

At step 210, acoustic responses for both ears are computed at runtime by using this efficient plane-wave decomposition of the pressure field and the HRTF-based listener directivity. In some embodiments, these binaural acoustic responses are convolved with the (dry) audio to compute the propagated spatial sound at the listener position.

In some embodiments, exemplary process 200 may be incorporated into the state-of-the-art boundary element method [Liu 2009] and the interactive equivalent source technique [Mehra et al. 2013]. In such embodiments, existing implementations of the state-of-the-art boundary element method and the interactive equivalent source technique may be computationally efficient up to a few kHz.

In some embodiments, exemplary process 200 or a runtime portion therein may be integrated with Valve's Source™ game engine. Using this game engine, acoustic effects from both source and listener directivity on a variety of scenarios are demonstrable, such as people talking on the street, loudspeakers between buildings, a television in a living room, a helicopter in a rocky outdoor terrain, a bell tower in a snow-covered town, a rotating siren, a helicopter behind obstacles, and musical instruments in an amphitheater.

In some embodiments, results associated with exemplary process 200 may be validated by comparing these results to results computed analytically using the offline Biot-Tostoy-Medwin (BTM) technique [Svensson et al. 1999].

In some embodiments, exemplary process 200 enables accurate sound propagation for directional sources and can handle moving directional sources and a moving directional listener.

In contrast to conventional or known approaches, exemplary process 200 and/or other aspects described herein include an approach that allows modifiable source directivity and HRTF-based listener directivity at runtime for interactive wave-based sound propagation.

Figure 3:
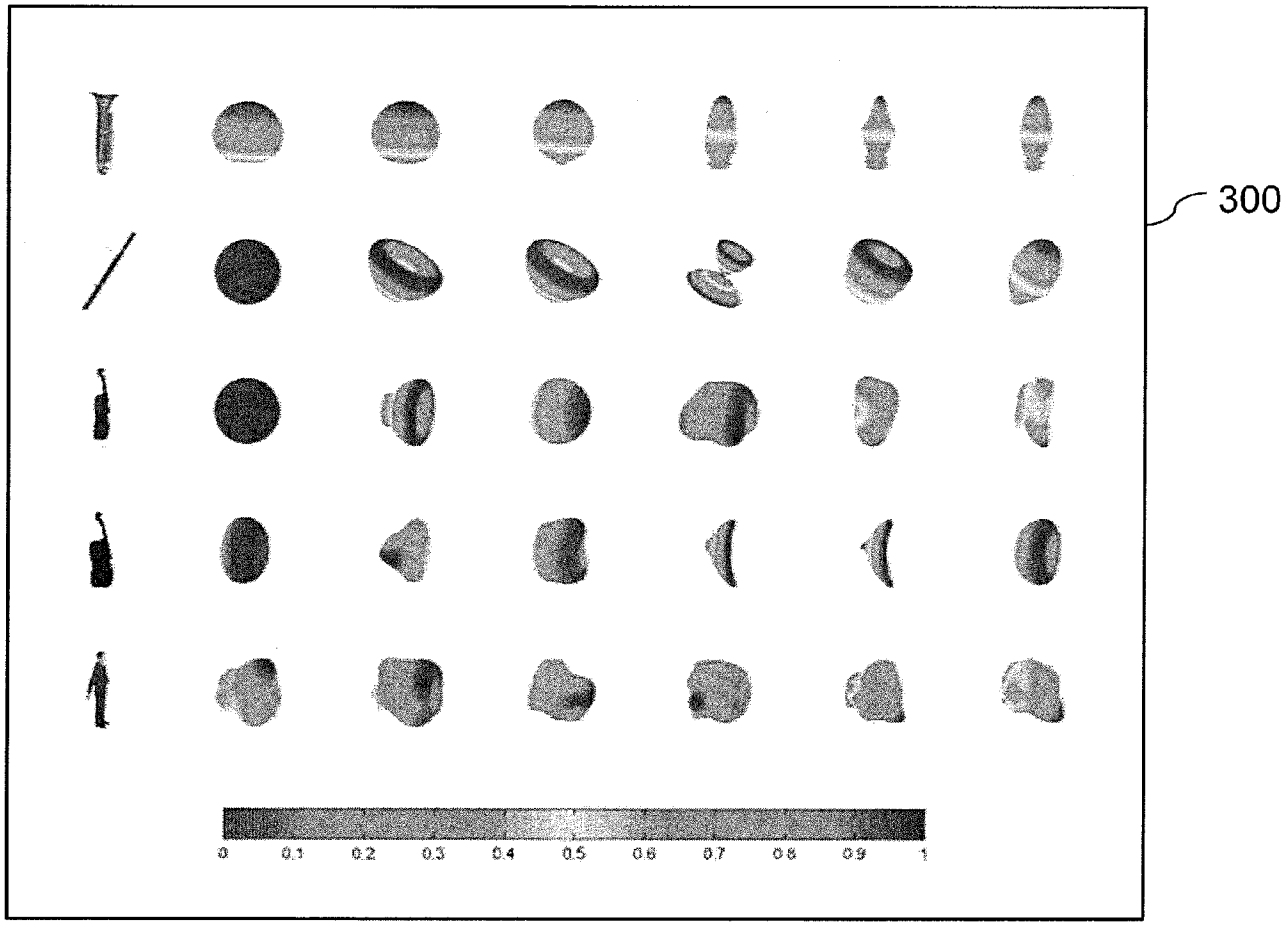
FIG. 3 is a diagram illustrating that directivity varies with frequency.

FIG. 3 includes a diagram 300 illustrating that directivity varies with frequency. Diagram 300 shows source directivity of musical instruments and a human singer corresponding to different frequency octaves: [0-176] Hz, [177-354] Hz, [355-710] HZ, [711-1420] Hz, [1420-2840] Hz, and [2841-5680] Hz. As depicted in diagram 300, these directivity patterns are visualized by fitting SH-based source representation (error threshold 5%) on the real-world measurement data provided by Meyers et al. [1978].

3 Source Directivity

In this section, aspects related to handling directional sources in a general frequency-domain wave-based sound propagation technique are presented as an overview. In one exemplary embodiment, a source formulation is presented that incorporates the complete radial and directional sound radiation from sources. Next, a far-field representation of this source formulation is discussed that can be used to efficiently handle data-driven, and rotating or time-varying source directivities. Based on the linearity of the Helmholtz equation, aspects of the present subject matter are provided that incorporates an exemplary source representation as described herein into a general frequency-domain wave-based propagation technique. In some embodiments, all the variables used in an exemplary approach, except the SH basis functions, positions and speed of sound are frequency dependent. For the sake of brevity these dependencies are not mentioned explicitly.

3.1 Source Formulation

The radiation pattern of a directional source can be expressed using the one-point multipole expansion [Ochmann 1995] as:

$$s(x, y) = \sum_{l=0}^{L-1} \sum_{m=-l}^{l} b_{lm} h_l^2(2\pi v r / c) Y_{lm}(\theta, \phi), \tag{1}$$

where s(x, y) is the pressure field (/sound field) at point x of the directional source centered at point γ, $h_2^l(.)$ are the spherical Hankel functions of the second kind, $Y_{lm}(.)$ are complex-valued SH basis functions [Hobson 1955], (r, θ, ϕ) is the vector (x−y) expressed in spherical coordinates, $b_{lm}$, are weights of the expansion and L is order of the expansion, c is the speed of sound in the medium (343 m/s for air at standard temperature and pressure) and v is the frequency. This source formulation is valid in both near and far-fields[1].

3.2 Source Representation

The selection of source representation for directional sources may be motivated by the measured directivity data that is currently available for real-world sources. Most available measurements has been collected by placing sources in an anechoic chamber and recording their directivity by rotating microphones every few degrees at a fixed distance from the source. Typically, these measurements are carried out at a distance of a few meters, which corresponds to the far-field for the frequencies emitted by these sources2. Keeping this in mind, a source representation that corresponds to the far-field radiation pattern of a directional source is selected. Under far-field approximation, $h_l^2(z) \approx i^{l+1} e^{-iz}/z$ where $i=\sqrt{-1}$ resulting in the following source representation [Menzies 2007]:

$$s(x, y) = \frac{e^{-i2\pi v r/c}}{r} \sum_{l=0}^{L-1} \sum_{m=-l}^{l} a_{lm} Y_{lm}(\theta, \phi), \tag{2}$$

$$= \frac{e^{-i2\pi v r/c}}{r} D(\theta / \phi), \tag{3}$$

where $\alpha_{lm}=b_{lm} i^{l+1} c/(2\pi v)$ are the SH coefficients and $D(\theta, \phi)=\Sigma\Sigma\alpha_{lm}\gamma_{lm}(\theta, \phi)$ is the directivity function at frequency v. This directivity function can be either specified for each frequency analytically or measured or simulated at discrete sample directions. Depending on the data, the directivity function can be a complex-valued (both magnitude and phase) or a real-valued (magnitude-only). Typically, the measured data is magnitude-only and available as directivities averaged over octave-wide frequency bands [PTB 1978].

The coefficients $\alpha_{lm}$ of the source representation is computed from the D(θ, ϕ) as follows:

Analytical: Given an analytical expression for the directivity function D(θ, ϕ), the coefficients $\alpha_{lm}$ can be computed by SH projection as follows:

$$\alpha_{lm}=\int_0^{2\pi}\int_0^{\pi} D(\theta,\phi) Y_{lm}(\theta,\phi) \sin\theta d\theta d\phi. \tag{4}$$

This expression can be evaluated either symbolically or numerically, depending on D(θ, ϕ) [Green 2003].

Data-driven: Given the directivity function D(θ, ϕ) at sampled locations $\{(\theta_1,\phi_1)(\theta_2, \phi_2), \ldots, (\theta_n, \ldots, \phi_n)\}$, the spherical harmonic expansion can be fitted to this function in the least-square sense, by solving an over-determined linear system ($n>L^2$) to compute the coefficients $a_{lm}$ $$\sum_l \sum_m Y_{lm}(\theta_k, \phi_k) a_{lm} = D(\theta_k, \phi_k). \text{ for } k = 1, \ldots, n; \tag{5}$$

An exemplary source formulation described herein and the corresponding spherical harmonic representation can handle both complex-valued and real-valued directivities. In case the directivity function is real-valued (as the widely available measured data is magnitude only), the real-valued SH basis [Green 2003] is used in the aforementioned expressions.

3.3 Frequency-Domain Sound Propagation

In this section, aspects related to an exemplary approach for incorporating the directional source representation in a general frequency domain, wave-based sound propagation technique are disclosed. The steps outlined below are repeated for frequency samples in the range [0; $v_{max}$], where $v_{max}$ is the maximum frequency simulated.

Helmholtz equation: Sound wave propagation in the frequency-domain can be expressed as a boundary value problem using the Helmholtz equation:

$$\nabla^2 p + \frac{\omega^2}{c^2} p = 0 \text{ in } \Omega, \tag{6}$$

where p(x) is the complex-valued pressure field at v (frequency), w=2πv is the angular frequency, c is the speed of sound, Ω is the propagation domain, and $\nabla^2$ is the Laplacian operator. The behavior of p at infinity must be specified using the Sommerfeld radiation condition [Pierce 1989]. In order to complete the problem specification, either a Dirichlet, Neumann or mixed boundary condition is specified at the boundary of the domain. This equation can be solved using any frequency-domain wave-based numerical technique, including the boundary element method, the finite element method or the equivalent source method.

Directional sources: The linearity of the Helmholtz equation implies that the pressure field of a linear combination of sources is a linear combination of their respective pressure fields [Pierce 1989]. In one exemplary embodiment, a source representation for directional sources described herein is a linear combination of elementary spherical harmonic sources $s_{lm}(x,y)=e^{-l2\pi vr/c}/rY_{lm}$ with different weights $a_{lm}$ (equation 2). Therefore, for a given scene, the pressure field $p_{lm}(x)$ corresponding to each of the elementary sources $s_{lm}(x,y)$ is computed, then the pressure field due to any arbitrary directional source s(x, y) can be expressed as the linear combination of the precomputed pressure fields of the elementary sources with the same weights $a_{lm}$:

$$\underbrace{\sum_l \sum_m a_{lm} s_{lm}(x, y)}_{s(x,y)} \longrightarrow \underbrace{\sum_l \sum_m a_{lm} p_{lm}(x)}_{p(x)}.$$

The pressure fields for elementary sources can be computed using any underlying numerical solver. In the case of interactive applications, this computation is performed during the preprocessing stage, and the resulting pressure field data is efficiently encoded and stored. This pressure field data completely defines the acoustic response to any directional source at the given position up to the SH approximation order. At runtime, the specified source directivity D(θ,ϕ) is decomposed into a spherical harmonic-based representation, using Equations (4) or (5), and the resulting weights $a_{lm}$ are used to compute the final acoustic response $p(x_0)$ at listener position $x_0$, as described above.

Time-varying and rotating directivity: For a source with time-varying directivity, the spherical harmonic decomposition (5) of the source directivity function D(θ, ϕ) is computed at runtime at interactive rates using fast linear solvers as discussed in detail in Section 6. For the special case of a rotating directional source, the new SH coefficients after rotation can be computed by applying the SH rotation matrix to the original SH coefficients [Green 2003]. Section 6 describes an exemplary method for handling directivity for dynamic sources in further detail.

Figure 4:
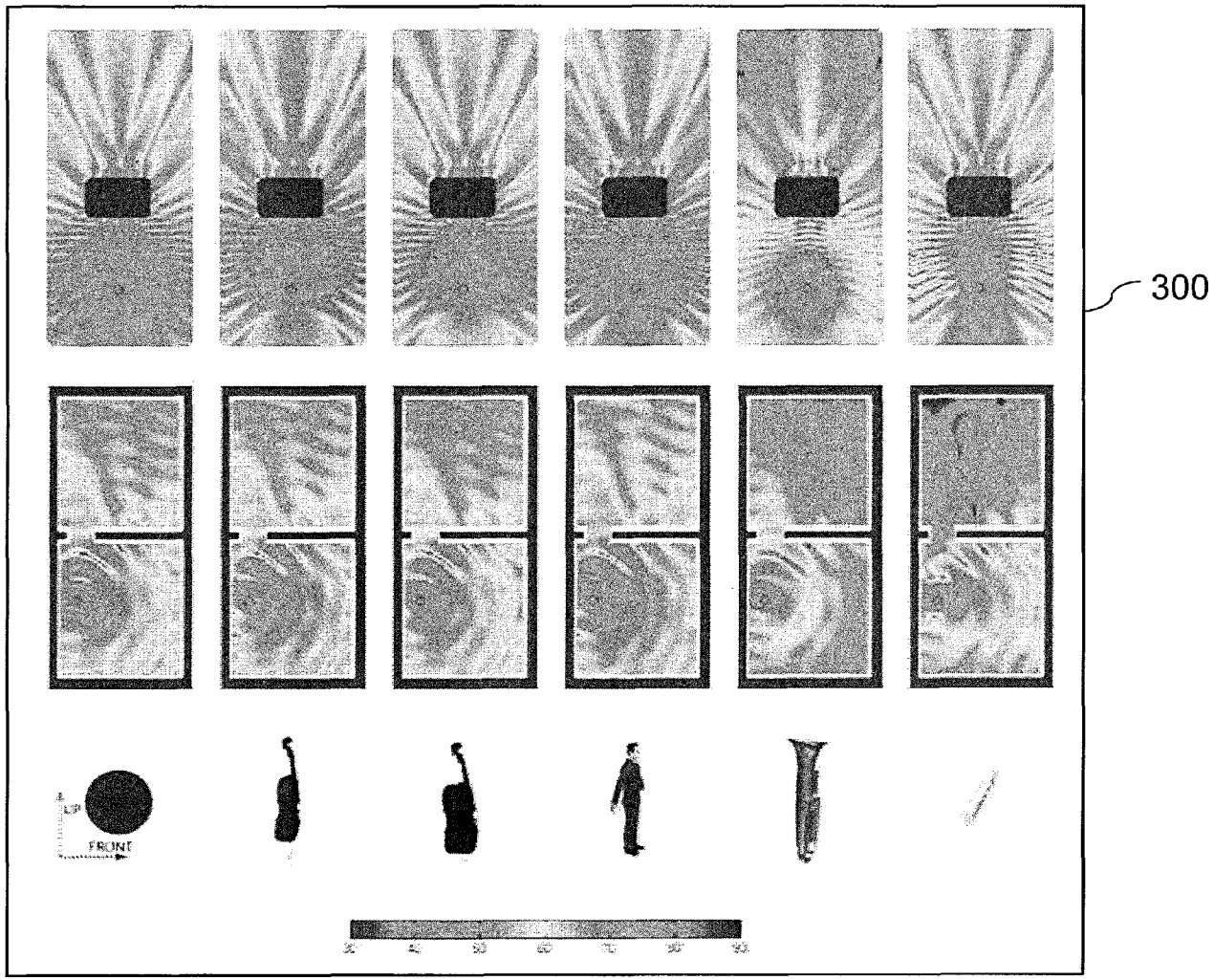
FIG. 4 is a diagram illustrating that directivity affects sound propagation.

FIG. 4 includes a diagram 400 illustrating that directivity affects sound propagation. Referring to FIG. 4, pressure fields are depicted on a grid of listener positions for a single building scene and a living room scene at 360 Hz with different directional sources. Source position is shown with a dot. Front axis points towards the building. Up axis points upwards perpendicular to the listener grid.

4 Listener Directivity

Aspects related to a fast and efficient method of computing listener directivity for any frequency-domain, wave-based sound propagation technique is disclosed herein. In one exemplary embodiment, the plane-wave decomposition of the sound field is computed around the listener, the plane-wave coefficients is expressed in terms of a SH basis, and the pressure and its derivatives at the listener position is used to compute the SH coefficients. The head-related transfer function (HRTF) is also expressed in the SH basis. At runtime, spatial sound can be computed as a dot product between the SH coefficients of the sound field and the HRTF.

4.1 Sound Field Decomposition Using Derivatives

In the frequency domain, the global sound field can be expressed as a superposition of pressure due to plane waves [Duraiswami et al. 2005]. This basis is also known as the Herglotz wave basis, with the basis functions centered at listener position $x_0$:

$$\psi_s(x)=e^{iks\cdot(x-x_0)}, \tag{7}$$

where $s=(s_x; s_y; s_z)$ is the unit vector in the direction of plane wave propagation, k=2πv/c is the wave number, v is the frequency, and c is the speed of sound. In terms of these basis functions, the total pressure at x can be determined by integrating over all directions:

$$p(x) = \frac{1}{4\pi} \int_S \psi_s(x)\mu(s)ds, \tag{8}$$

where μ(s), also known as the signature function [Zotkin et al. 2010], specifies the complex-valued amplitude of the plane wave traveling along direction s, for a given frequency v. The signature function can be further decomposed using complex-valued SH basis functions, yielding:

$$p(x) = \frac{1}{4\pi} \sum_l \sum_m \alpha_{lm} \int_S \psi_s(x) Y^*_{lm}(s)ds, \tag{9}$$

where $Y^*_{lm}(s)$ is the complex conjugate of the SH basis functions $Y_{lm}(s)$ and $\alpha_{lm}$ are the corresponding coefficients. The plane wave basis functions, shown in equation (7), have an important property: all of the basis functions have zero phase at the listener position $x_0$. In other words, $\psi_s(x_0)=1$, ∀s. Based on this property and the orthonormality of the SH basis, it may be proven that the SH-based plane-wave decomposition of the pressure field can be computed up to any order by computing the derivatives of the pressure field up to the same order.

Theorem: The sound field of the entire domain can be expressed in terms of pressure and its derivatives at a single point. Given the polynomial expression of the $n^{th}$ order and $q^{th}$ degree SH $$Y_{nq}(s) = A \sum_{(a,b,c)} \Gamma_{a,b,c} s_x^a s_y^b s_z^c, \tag{10}$$

where a≥0, b≥0, n≥0 and a+b+c=n, the corresponding SH coefficient in the plane-wave decomposition of the pressure field is $$\alpha_{nq} = A \sum_{(a,b,c)} \Gamma_{a,b,c} \frac{4\pi}{(ik)^{a+b+c}} p^{(a,b,c)}(x_0), \tag{11}$$

where $$p^{(a,b,c)} = \frac{\partial^{a+b+c} p}{\partial x^a \partial y^b \partial z^c}.$$

The above expression and equation 9 gives the plane-wave decomposition of sound field in terms of pressure and its high-order derivatives at point $x_0$.

See Appendix A in supplementary text for proof, and Section 5 for details on calculating the derivatives $p^{(a,b,c)}$. The above result is used in Section 4.2 to compute the spatial sound at both ears as a dot product of SH coefficients of plane-wave decomposition of the sound field and HRTFs.

4.2 Sound Rendering Using HRTFs

The HRTF relates the pressure received at each ear of the listener to the pressure at a point positioned at the center of the listener's head, and accounts for scattering from the head. a SH decomposition of the left and right ear HRTFs are performed, $H_L(s)=\Sigma_l\Sigma_m\beta_{l'm'}{}^{L}Y_{l'm'}(s)$ and $H_R(s)=\Sigma_l\Sigma_m\beta_{l'm'}{}^{R}Y_{l'm'}(s)$. Similar to Rafaely et al. [2010], the pressure received at left and right ear ($p_L$ and $p_R$) can be expressed as a dot product of the SH coefficients of the sound field and the HRTFs (see Appendix B in supplementary text for details).

$$p_L = \frac{1}{4\pi}\sum_l \sum_m \beta_{lm}^L \alpha_{lm},\ p_R = \frac{1}{4\pi}\sum_l \sum_m \beta_{lm}^R \alpha_{lm}. \tag{12}$$

4.3 Accuracy

As shown in Section 5, pressure derivatives (equation 11) may be computed by differentiating the pressure basis functions analytically rather than using a finite difference stencil. Therefore, higher-order derivatives do not suffer from numerical instabilities, allowing the SH coefficients of the sound field to be computed to any desired order. Rafaely et al [2010] conducted a study on the effect of SH order on spatial perception. The results indicate that: a SH order of 1-2 is sufficient for spatial perception of frequencies up to 1 kHz; a SH order of 3 suffices up to 2 kHz; and a SH order of 3-6 suffices up to 8 kHz. Higher SH order results in better spatial resolution, but computing the higher-order derivatives also increases the computational cost. Therefore, the SH order may be determined based on a performance-accuracy trade-off.

4.4 Interactive Applications

Some aspects of the present subject matter allow spatial audio to be computed efficiently using two dot products (left and right ear) of complex-valued vectors. This enables the use of HRTF-based listener directivity for interactive wave-based sound propagation techniques as compared to previous approaches which are offline. Some aspects of the present subject matter also provide the flexibility of using individualized (user-specific) HRTFs without recomputing the simulation results. In one exemplary approach, only the SH coefficients of the individualized HRTFs need to be updated; the SH coefficients of the sound field remain the same. Additionally, some aspects of the present subject matter enable head-tracking for a moving and rotating listener at interactive rates by simplifying the head rotation computation using SH rotation matrices.

Figure 5:
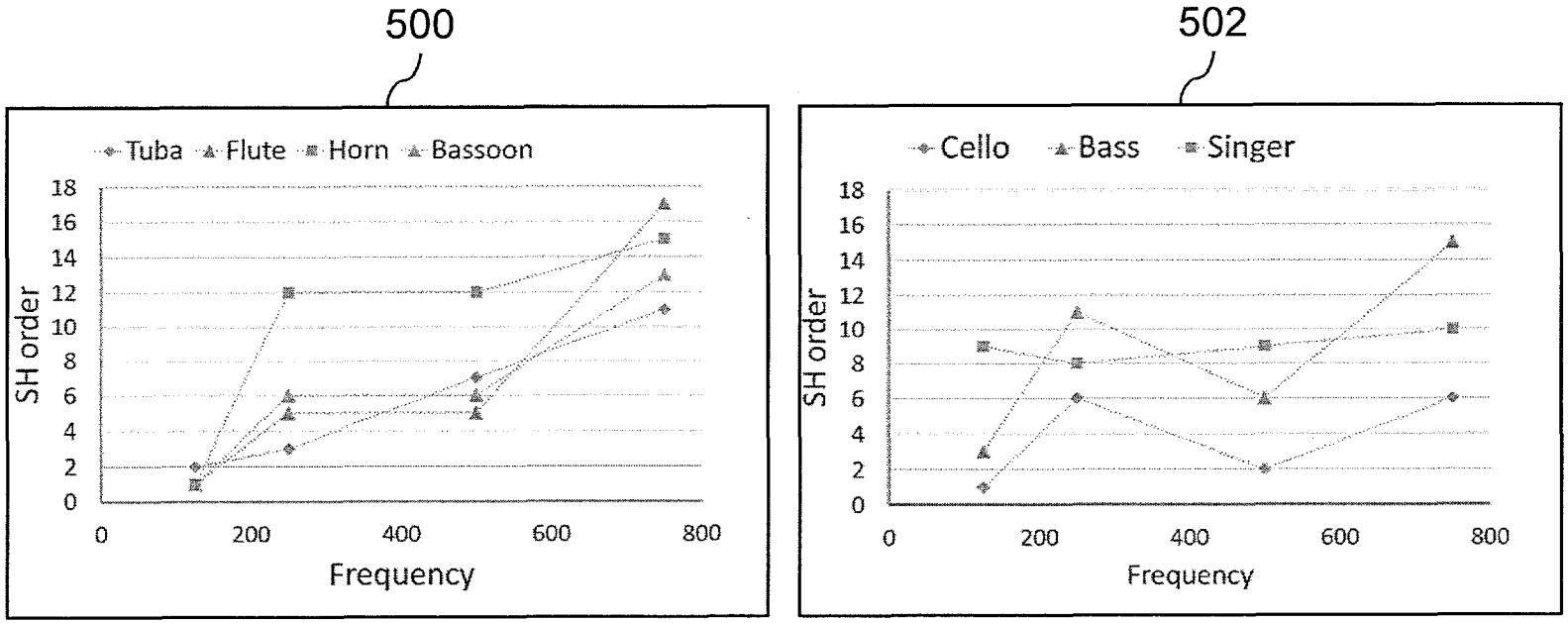
FIG. 5 includes two graphs illustrating that directivity of sound sources becomes sharper with frequency.

FIG. 5 includes two graphs illustrating that directivity of sound sources becomes sharper with frequency. FIG. 5 includes graph 500 and graph 502. Each of graphs 500 and 502 depict directivity of different sound sources. Referring to FIG. 5, each of graphs 500 and 502 indicates that directivity of sound source becomes sharper as frequency increases. As indicated by graphs 500 and 502, higher-order SH source representation are required to approximate the directivity function at higher frequencies while maintaining a constant error threshold of 5%.

5 Wave-Based Sound Propagation

In this section, aspects associated with integration of an exemplary source and listener directivity representation described herein with frequency-domain wave-based sound propagation techniques are disclosed. In order to demonstrate that an exemplary directivity representation described herein can be incorporated in any frequency-domain wave-based technique, the exemplary directivity representation has been integrated with the state-of-the-art boundary element method [Liu 2009] and the interactive equivalent source method [Mehra et al. 2013].

5.1 Boundary Element Method (BEM)

The boundary element method is a standard numerical technique used for solving the 3D Helmholtz equation for accurate sound propagation in indoor and outdoor spaces. BEM transforms the Helmholtz equation into boundary integral equations and solves for pressure and velocity on the boundary, and thereby pressure at any point in the domain.

Simulation: Given an indoor or outdoor scene with source position y, the Helmholtz equation corresponding to the elementary spherical harmonic source $s_{lm}(x,y)$ is solved using BEM. This gives pressure $q_{lm}(z)$ and velocity $v_{lm}(z)$ on the domain boundary (z is a point on the boundary). This step is repeated for all the elementary sources $$s_{lm}(x, y) = \frac{e^{-i2\pi\nu r/c}}{r} Y_{lm}$$

in the spherical harmonic expansion (Equation 2).

Pressure evaluation: The pressure field p(x) for the elementary spherical harmonic sources $s_{lm}(x)$ is computed at the listener position x by using the boundary integral equation:

$$p_{lm}(x)=\int_S[G(x,z,\omega)q_{lm}(z)-F(x,z)v_{lm}(z)]dS(z)+s_{lm}(x,y),$$

where $$G(x, z, \omega) = \frac{1}{4\pi d} e^{iwd/c}$$

is the Green's function $$(d = \|x - z\|),\ F(x, z) = \frac{\partial G(x, z, \omega)}{\partial n(z)}$$

and n(z) is normal at a boundary point z.

For a source s(x, y) with directivity function D(θ, ϕ) placed at point γ, the coefficients $a_{lm}$ corresponding to its spherical harmonic expansion are computed (Equations (4) and (5)). The final acoustic response (pressure field) to the directional source s(x, y) is computed as a linear combination of the pressure fields $P_{lm}(x)$ of the elementary sources $S_{lm}(x)$:

$$p(x) = \sum_l \sum_m a_{lm} p_{lm}(x). \tag{13}$$

Pressure derivative evaluation: In order to produce spatial sound at the listener position, the coefficients of the plane wave decomposition are determined using pressure and its first-order derivatives (Equations 9 and 11). The pressure is computed as shown above. The derivative of the pressure field due to elementary source $\partial p_{lm}(x)/\partial x$ is computed by differentiating the functions involved analytically:

$$\frac{\partial p_{lm}(x)}{\partial x} = \int_s \left[\frac{\partial G(x, z, \omega)}{\partial x} q_{lm}(z) - \frac{\partial F(x, z)}{\partial x} v_{lm}(z)\right] dS(z) + \frac{\partial s_{lm}(x)}{\partial x}.$$

The first-order derivative of the complete pressure field is computed as:

$$\frac{\partial p(x)}{\partial x} = \sum_l \sum_m a_{lm} \frac{\partial p_{lm}(x)}{\partial x}. \tag{14}$$

Higher order derivatives can be computed in a similar manner.

5.2 Equivalent Source Method (ESM)

Equivalent source technique [Mehra et al. 2013] can perform interactive wave-based sound propagation in large outdoor scenes. This technique decomposes the global pressure field of a scene into local per-object sound fields and inter-object interactions, which are precomputed offline. The pressure field is computed by solving a global linear system consisting of per-object and inter-object interactions, and encoded efficiently as the strengths of equivalent sources. At runtime, the acoustic response at a moving listener is efficiently computed by performing a fast summation over all the equivalent sources.

Preprocessing: Assume a scene composed of K objects, $A_1$, $A_2, \ldots, A_K$ and source position y. During the preprocessing stage, the elementary SH source $S_{lm}(x,y)$ are expressed in terms of the incoming equivalent sources of these objects. Next, the global solve step is performed to compute the strengths of outgoing equivalent sources for all the objects $(C_{lm})A_1, (C_{lm})A_2, \ldots, (C_{lm})A_K$. These outgoing equivalent source strengths represent an efficient encoding of the pressure field of the scene. This step is repeated for all the elementary sources $$s_{lm}(x, y) = \frac{e^{-i2\pi vr/c}}{r} Y_{lm}$$

in the spherical harmonic expansion (Equation 2), and the computed equivalent source strengths are stored for runtime use.

TABLE 1

Precomputation cost.

| ESM scenes | air volume | surface area | #objs./ #srcs | # freq./L | ESM-sim (wall-clk) |
|---|---|---|---|---|---|
| Crowd | $85^3$ m$^3$ | — | 0/1 | 250/4 | — |
| Music | $85^3$ m$^3$ | — | 0/1 | 250/3 | — |
| Wall | $85^3$ m$^3$ | 71 m$^2$ | 1/1 | 250/3 | 165 min |
| Parallel | $85^3$ m$^3$ | 142 m$^2$ | 2/1 | 250/3 | 195 min |
| Amphitheater | $180^3$ m$^3$ | 220 m$^2$ | 1/3 | 500/4 | 305 min |
| Reservoir | $180^3$ m$^3$ | 950 m$^2$ | 5/2 | 500/3 | 829 min |
| Christmas | $180^3$ m$^3$ | 2952 m$^2$ | 5/1 | 500/3 | 894 min |
| **BEM scenes** | **air volume** | **surface area** | **#srcs** | **# freq./L** | **BEM-sim (wall-clk)** |
| Empty room | 24 m$^3$ | 60 m$^2$ | 1 | 250/4 | 45 min |
| Furnished room | 66 m$^3$ | 142 m$^2$ | 1 | 250/4 | 700 min |

Abbreviations:
"#objs." number of ESM objects in the scene,
"#srcs" number of directional sound sources,
"#freq." number of frequency samples in the range (0-1 kHz),
"L" is the SH order, and
"ESM-sim" or "BEM-sim" is the total wall clock time to compute pressure fields using the ESM or BEM propagation techniques respectively.
The sound-propagation computations are performed in parallel for all the elementary SH sources for all the frequencies on a 64-node cluster with 8 cores per node.
'Crowd' and 'Music' scenes have no precomputation time since only free-space propagation is performed.

Runtime: The final acoustic response due to the directional source s(x, y) is computed using (Equation 13). The stored equivalent source strengths is used to compute the pressure fields $p_{lm}(x)$ for the elementary spherical harmonic sources $s_{lm}(x)$ at the listener position x:

$$p_{lm}(x) = \sum_{j=1}^{k} (C_{lm})^{tr}_{A_j} \Phi^{out}_{A_j}(x) + s_{lm}(x). \tag{15}$$

The derivatives of the pressure field are computed as before (Equation 14). The derivative of the pressure field due to elementary source $\partial p_{lm}(x)/\partial x$ is computed by analytically differentiating the functions involved: the equivalent source basis functions $\Phi^{out}(x)$ (as defined in [Mehra et al. 2013]) and the source field $S_{lm}(x)$.

$$\frac{\partial p_{lm}(x)}{\partial x} = \sum_{j=1}^{k} (C_{lm})^{tr}_{A_j} \frac{\partial \Phi^{out}_{A_j}(x)}{\partial x} + \frac{\partial s_{lm}(x)}{\partial x}. \tag{16}$$

Figure 6:
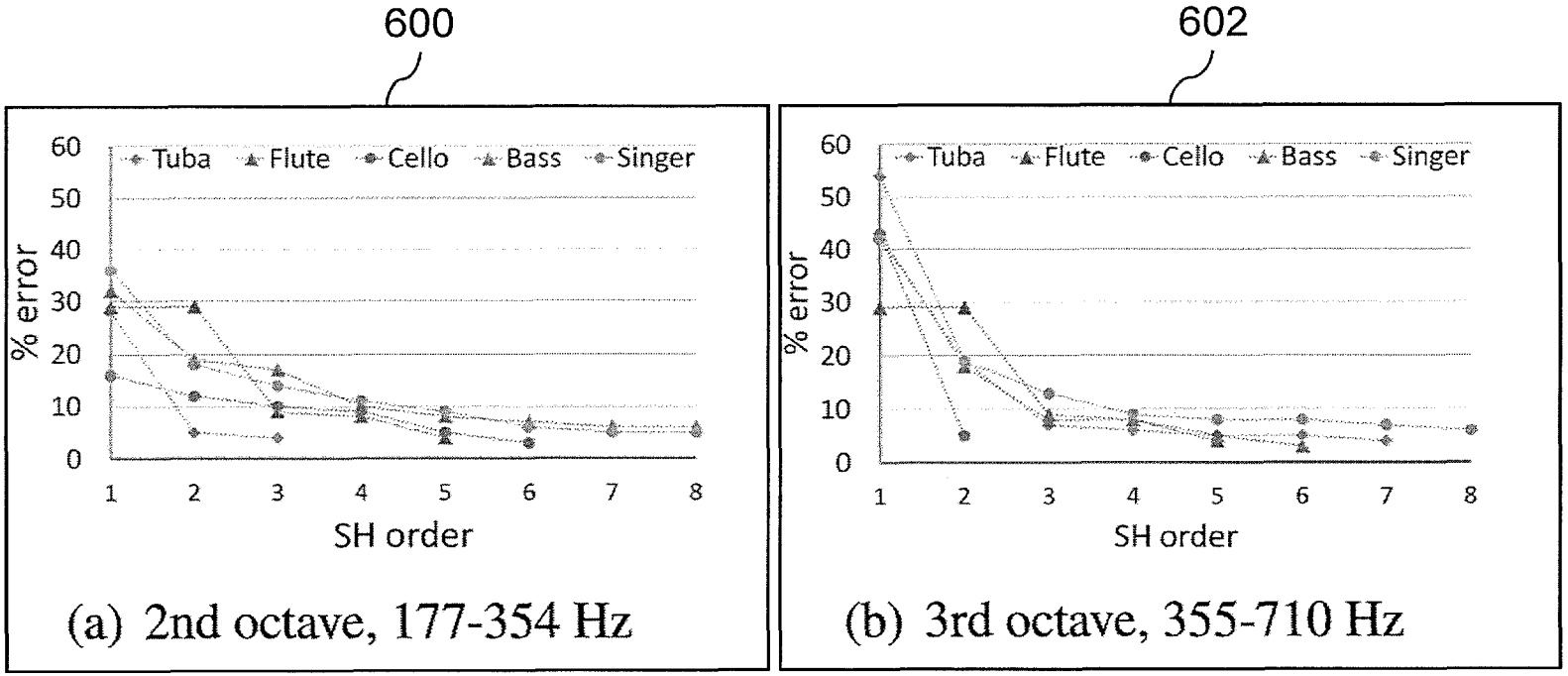
FIG. 6 includes two graphs illustrating that spherical harmonic (SH)-based source representation converges to the measured directivity data with higher SH orders.

FIG. 6 includes graph 600 and graph 602. Graph 600 depicts that SH-based source representation converges to the measured directivity data with higher SH orders. As depicted, graph 600 is associated with frequencies in the $2^{nd}$ octave (177 Hz-354 Hz) and graph 602 is associated with frequencies in the $3^{rd}$ octave (355 Hz-710 Hz).

6 Implementation

In this section, details for an exemplary implementation of a listener directivity approach described herein is disclosed. In this exemplary implementation, a 64-bit FAST-BEM implementation of the fast multipole boundary element method (www.fastbem.com) is used. For ESM, the preprocessing code is implemented in MATLAB. The runtime code is implemented in C++ and has been integrated with Valve's Source game engine. The timing results for the BEM and ESM precomputation are measured on a 64-node CPU cluster (Xeon 5560 processor nodes, 8 cores, 2.80

GHz, 48 GB memory). The precomputation for each frequency is performed in parallel over all the nodes of the cluster. The timing results of the exemplary runtime system are measured on a single core of a 4-core 2.80 GHz Xeon X5560 desktop with 4 GB of RAM and NVIDIA GeForce GTX 480 GPU with 1.5 GB memory. Acoustic responses are computed up to the maximum simulation frequency of 1 kHz.

Measurement data: The source directivity data used in the exemplary system is extracted from real-world measurement data provided by Meyers et al. [PTB 1978]. The data is magnitude only and averaged over the frequencies in each octave band and is provided for all the octave bands within the frequency range of the sound sources. SH order L=3 or 4 is used for the source representation, which gives less than 10-15% error (see FIG. 6). Error is defined as $$\sqrt{\frac{\Sigma_i\Sigma_j\|D(\theta_i,\phi_j)-D_{SH}(\theta_i,\phi_j)\|^2}{\Sigma_i\Sigma_j\|D(\theta_i,\phi_j)\|^2}}$$

where D is the measured directivity data and $D_{SH}$ is the SH-based source directivity representation (Equation 2). For spatial sound, the HRTF dataset provided by Algazi et al. is used, particularly for the KEMAR dummy. The SH coefficients of this HRTF are computed in a manner similar to Equation 5.

Rotating sources and time-varying directivity: The SH coefficients of the directivity after rotation by an angle $\phi$ about the z axis can be obtained by multiplying the vector of unrotated SH coefficients by the blockwise-sparse matrix given in [Green 2003, p. 23]. Matrices can also be derived for more general rotations about arbitrary axes [Green 2003, p. 21-26]. For handling time-varying directivity, Intel MKL is used to solve the linear system corresponding to the SH decomposition of the directivity function (Equation 5) at interactive rates during runtime.

Dynamic sources: In order to enable dynamic (moving) sources, pressure fields are precomputed due to the elementary SH sources at sampled positions in the environment and, at runtime, spatial interpolation is used to perform sound propagation for dynamic sources as proposed in [Raghuvanshi et al. 2010]. The memory requirement scales linearly with the number of sampled positions.

Auralization: Acoustic responses for elementary sources precomputed using the equivalent source technique and the SH coefficients of the HRTF are loaded into Valve's game engine upon startup. At runtime, the acoustic responses of the elementary sources are evaluated and extrapolated to the output frequency (22 kHz), similar to [Mehra et al. 2013]. SH coefficients are computed based on the specified source directivity and are used to generate the total pressure field and its derivatives at the listener position. As the listener (player) moves through the scene, the computed pressure and pressure derivatives are combined with the SH coefficients of the HRTF to compute binaural frequency responses to produce spatial sound at the listener. These frequency response computations are performed asynchronously from both the visual rendering pipeline and the audio processing pipeline. As shown in Table 2, an exemplary technique described herein can update binaural frequency responses at a rate of 10-15 Hz or more, which is sufficient for audio applications [IASIG 1999], while the game itself is able to perform visual rendering at 60 frames per second (or more). Audio processing is performed using FMOD (with Fourier transforms computed using Intel MKL), and rendered in frames of 1024 samples.

Figure 7:
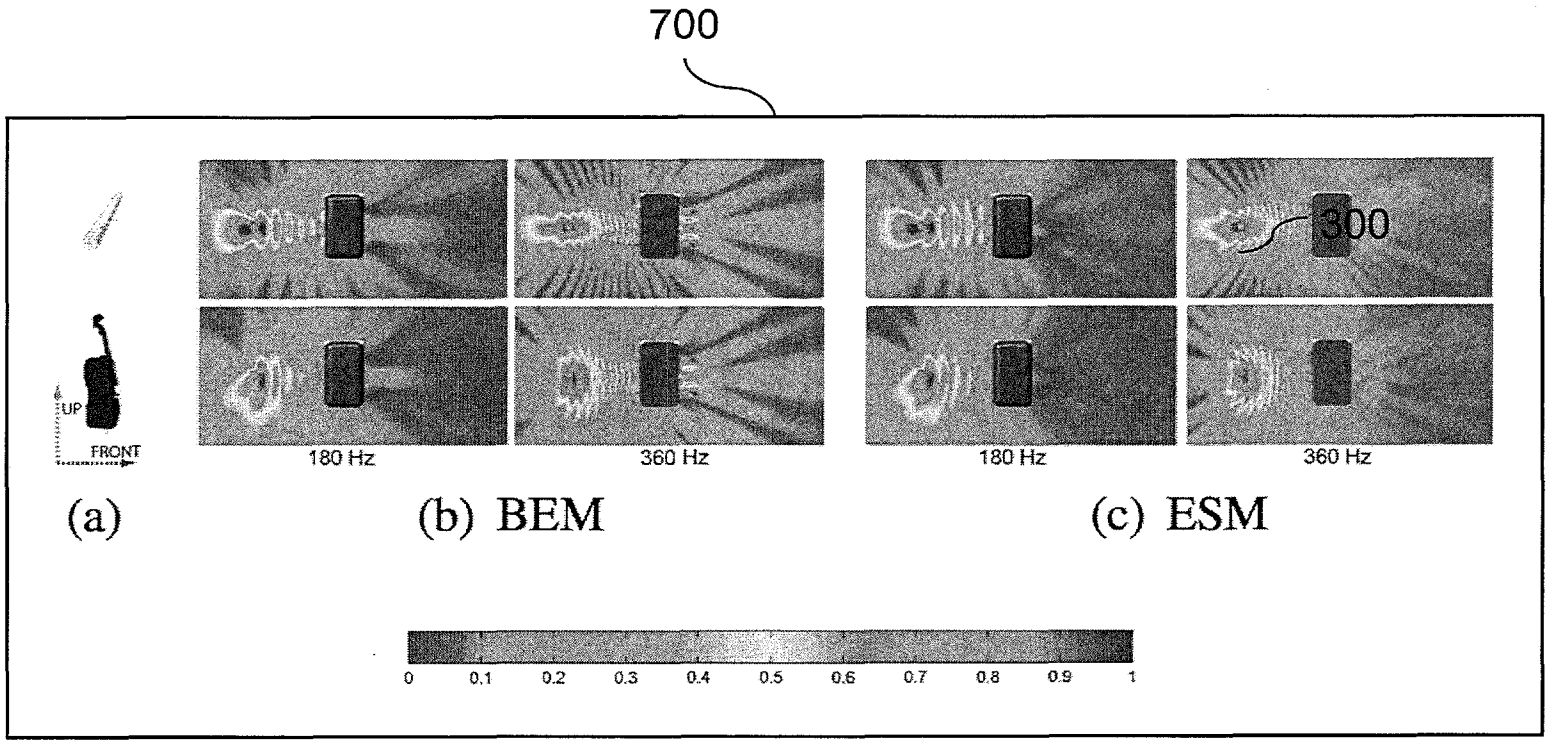
FIG. 7 is a diagram illustrating integration of source directivity with various frequency-domain techniques.

FIG. 7 depicts a diagram 700 illustrating integration of source directivity with various frequency-domain techniques. In particular, diagram 700 shows the pressure field (in Pa, normalized [0,2]) computed by the offline BEM simulation and the interactive ESM technique for directional sources in a single wall scene at 180 Hz and 360 Hz. Source position is shown with a dot. Front axis points towards the building. Up axis points upwards perpendicular to the listener grid.

The BEM error tolerance and order of multipole expansion was set to 1% and 6, respectively. ESM error thresholds for scattering and interactive matrices are 15% and 1%, respectively. These error thresholds were chosen for interactive performance and can be reduced to achieve higher accuracy. The pressure fields produced by the two techniques agree within error of <5-10%. The offline BEM method has a much higher time and memory overhead, but the resulting pressure fields are more accurate.

7 Results

In Table 1, the cost of precomputing the pressure fields using BEM and ESM are shown. Since the computation for all sound sources, the elementary SH sources and different frequencies are independent, all these computations can be easily performed in parallel. Table 2 shows the runtime performance and memory requirements of the ESM technique for computing the acoustic response for arbitrary source directivity at a moving listener. For the case of dynamic source in parallel buildings, 30 sampled positions in the scene were selected. FASTBEM computes the acoustic response (pressure evaluation) for the empty room and the furnished room at the listener position in 3 and 5 seconds, respectively. The storage cost for the BEM pressure fields is 716 MB and 1.4 GB for the empty and furnished room, respectively. BEM has much higher memory requirement than the ESM (Table 4 in [Mehra et al. 2013]) since it captures the sound-field interactions close to the surface of the object. ESM, on the other hand, captures the sound-field interactions outside the object's offset surface. As stated above, FIG. 5 shows that, as the frequency of different sound sources grows higher, higher order terms in the SH representation are needed. As a general trend, sound source directivities become sharper (more prominent) with increasing frequency, requiring higher order SH basis functions.

TABLE 2

ESM runtime performance.

| Scene | L | # eq. srcs | eval. (no spatial, per src) | eval. (spatial, per src) | storage (total, fixed + per src) |
|---|---|---|---|---|---|
| Crowd | 4 | — | 0.14 ms | 0.34 ms | — |
| Music | 3 | — | 0.14 ms | 0.34 ms | — |
| Wall | 3 | 0.1M | 12.6 ms | 16.7 ms | (1 + 29) MB |
| Parallel | 3 | 0.2M | 17.9 ms | 24 ms | (2 + 58) MB |
| Amphitheater | 4 | 0.1M | 14 ms | 18.6 ms | (1 + 51) MB |
| Reservoir | 3 | 0.8M | 86 ms | 115 ms | (10 + 230) MB |
| Christmas | 3 | 0.7M | 90.6 ms | 119.5 ms | (8 + 202) MB |

"L" is the SH order, and

"# eq. srcs" number of equivalent sources (in millions).

For each scene, the runtime performance "eval." with and without spatial sound and the storage requirement "storage" are shown.

Storage numbers indicate fixed cost for equivalent source positions and the total cost for storing their strengths for all elementary SH sources up to SH order L.

'Crowd' and 'Music' scenes do not have any equivalent sources since only free-space propagation is performed.

7.1 Scenes

In a related video, auralizations are modeled for the various scenes listed in Table 2 with principles and/or effects demonstrated described below. Parallel buildings and an empty living room: A comparison between the sound propagation for an omnidirectional source and a directional source is shown. Furnished living room: The sound propagation due to a television (a typical directional source) in the living room setting is shown and low-passing of diffracted sound behind doors is demonstrated.

Wall: Using an exemplary listener directivity approach described herein enables an listener to localize the direction of the sound source. Also, time-varying source directivity caused by the motion of an obstacle in front of the source is shown.

Reservoir (from Half-Life 2): An exemplary listener directivity approach described herein has been integrated with an existing game engine (Valve Source™ game engine) to generate realistic acoustic effects from directional sources and listener.

Christmas town: The source directivity of bell tower and diffraction low-passing of sound behind houses are demonstrated.

Dynamic directional sources: To demonstrate source and listener directivity for dynamic sources and listeners, a helicopter flying between two parallel buildings and a moving player is demonstrated.

Amphitheater: Propagated sound due to directional sources at various locations around a real-world environment.

7.2 Validation

Source modeling: In the SH decomposition of the directivity function, no significant ringing was observed for the first four octave bands. For the last two octave bands, ringing was resolved by standard techniques (windowing the truncated SH coefficients using Lanczos sigma factors). SH-based source representation described herein converges to the measured directivity with increasing SH order, as shown in FIG. 6.

Sound propagation: In order to validate that an exemplary listener directivity approach described herein can correctly capture the effect of source directivity on sound propagation, validation experiments were performed against the Biot-Tolstoy-Medwin (BTM) method [Svensson et al. 1999]. This is an offline technique that provides a wideband reference solution with accurate diffraction in simple scenes and can incorporate source directivities. A data-driven SH-based directivity formulation described herein was integrated with the BTM Toolbox for MATLAB (www.iet.ntnu.norsvensson/software/index.html#EDGE). The BTM approach models edge diffraction by placing several secondary sources at positions sampled along the diffracting edges. Their intensities are determined only by the intensity of the sound source and the distance between the sound source and the secondary source. The strengths of each secondary source was scaled by the SH-approximated directivity function $D(\theta, \phi)$, where $(\theta, \phi)$ are determined by the direction vector from the source to the secondary source. BTM integral calculations were observed to be significantly slowed down due to the need to evaluate source directivity for each integration sample along each edge. BTM simulations were performed for musical instruments over three receiver positions and a fixed source position in the wall scene. Simulations for receivers 1, 2, and 3 took 57, 27, and 18 minutes, respectively. A supplementary video included receiver positions and auralizations.

8 Conclusion and Future Work

The present subject matter discloses aspects related to incorporating modifiable source directivity and HRTF3 based listener directivity in a general frequency-domain wave-based sound propagation techniques. Some aspects disclosed herein can automatically model wave-effects from low frequency directional sources. Some aspects disclosed herein can handle analytical, data-driven, rotating or time-varying directivity at runtime. The present subject matter also discloses aspects related to an efficient method for performing spatial sound rendering at interactive rates.

In some embodiments, directional sources with sharp directivity patterns (delta functions) may be expensive to handle with our current approach since it would require a very high-order SH expansion. As such, other basis functions (such as wavelets) may be usable to handle sharp directivities.

Source formulation described herein can handle both near- and far-field sound radiation by directional sources (equation 1). In some embodiments, near-field directivity may require a set of dense measurements of complex frequency responses very close to the source at twice the Nyquist rate, which is currently unavailable. In such embodiments, near-field directivity may be determined when such a dataset becomes available in the future.

In some embodiments, hybridization of wave-based techniques with geometric approaches may be utilized to handle directional sources over the complete audible frequency range.

In some embodiments, support for artist-controlled directivity may be added, thereby allowing real-time feedback of the effect of directivity on propagated sound.

It will be appreciated that while magnitude-only directivity data may be used in some aspects of the present subject matter, aspects of the present subject matter can easily support complex data (e.g., magnitude and phase), which we plan to test in the future.

Figure 8:
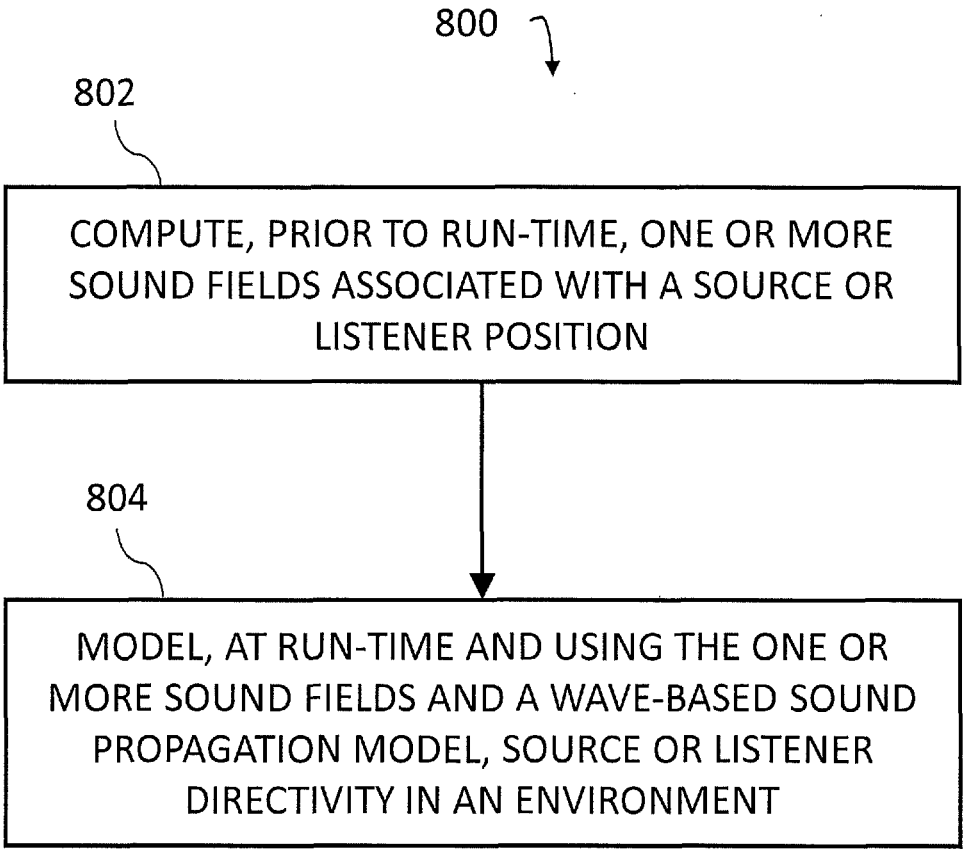
FIG. 8 is a diagram illustrating an exemplary process for supporting source or listener directivity in a wave-based sound propagation model according to an embodiment of the subject matter described herein.

FIG. 8 is a diagram illustrating an exemplary process 800 for supporting source or listener directivity in a wave-based sound propagation model according to an embodiment of the subject matter described herein. some embodiments, exemplary process 800, or portions thereof, may be performed by or at SPM 110, processor core(s) 108, node 102, and/or another node or module.

At step 802, one or more sound fields associated with a source or listener position may be computed prior to run-time. For example, SPM module 110 may be configured to precompute and store propagated sound fields or pressure fields due to SH sources.

In some embodiments, computing, prior to run-time, one or more sound fields associated with a source position may include using a one-point multipole method to represent a sound field radiated by a directional source and capturing directivity using spherical harmonic (SH) expansion.

In some embodiments, one or more precomputed sound fields may be associated with one or more elemental spherical harmonics sources located at the source position.

In some embodiments, one or more precomputed sound fields may represent one or more acoustic responses of the environment to any directivity at the source position.

At step 804, at run-time, source or listener directivity in an environment may be modeled using the one or more pressure fields and a wave-based sound propagation model. For example, SPM module 110 may compute a total sound field using a wave-based sound propagation technique at run-time, thereby allowing modeling of a source with a directivity that can be dynamically modified at run-time.

In some embodiments, run-time may occur when executing a sound propagation model application for the environment and precomputing may occur prior to run-time.

In some embodiments, modeling, at run-time and using the one or more sound fields and the wave-based sound propagation model, source or listener directivity in an environment may include generating, using the one or more sound fields, an acoustic response to an arbitrary time-varying or rotating directional source.

In some embodiments, modeling, at run-time and using the one or more sound fields and the wave-based sound propagation model, source or listener directivity in an environment may include performing a spherical harmonic (SH) decomposition of the source directivity, computing one or more SH coefficients corresponding to the SH decomposition, and computing an acoustic response of the environment, wherein the acoustic response is computed as a summation of the one or more sound fields evaluated at the listener position weighted by the one or more SH coefficients.

In some embodiments, computing an acoustic response using precomputed sound fields may involve convolving the acoustic response with source audio information to render the sound.

In some embodiments, acoustic responses for both ears may be computed using a head-related transfer function (HRTF).

In some embodiments, modeling, at run-time and using the one or more sound fields and the wave-based sound propagation model, source or listener directivity in an environment may include computing spatial sound as an inner product of spherical harmonic (SH) coefficients associated with an SH decomposition of the sound field and a head-related transfer function for a moving listener.

REFERENCES

The disclosures of all of the references listed herein are hereby incorporated herein by reference in their entireties.

[1] Ahrens, J., and Spors, S. 2012. Wave field synthesis of a sound field described by spherical harmonics expansion coefficients. *The Journal of the Acoustical Society of America* 131, 3, 2190-2199.

[2] Algazi, V., Duda, R., Thompson, D., and Avendano, C. 2001. The CIPIC HRTF database. In *Applications of Signal Processing to Audio and Acoustics,* 2001 *IEEE Workshop on the,* 99-102.

[3] Begault, D. R. 1994. 3*D Sound for Virtual Reality and Multimedia.* Academic Press.

[4] Blauert, J. 1983. *Spatial hearing: the psychophysics of human sound localization.* Mit Press.

[5] Boyd, J. P. 2001. *Chebyshev and Fourier Spectral Methods: Second Revised Edition,* 2 revised ed. Dover Publications, December

[6] Brebbia, C. A. 1991. *Boundary Element Methods in Acoustics,* 1 ed. Springer, October

[7] Calamia, P. T., and Svensson, P. U. 2007. Fast Time-Domain Edge-Diffraction Calculations for Interactive Acoustic Simulations. *EURASIP Journal on Advances in Signal Processing* 2007.

[8] Chadwick, J. N., An, S. S., and James, D. L. 2009. Harmonic shells: a practical nonlinear sound model for near-rigid thin shells. In *ACM SIGGRAPH Asia* 2009 *papers*, ACM, New York, N.Y., USA, 119:1-119:10.

[9] CLF. 2012. CLF: Common Loudspeaker Format (date last viewed Oct. 21, 2012).

[10] Duraiswami, R., Zotkin, D. N., Li, Z., Grassi, E., Gumerov, N. A., and Davis, L. S. 2005. High order spatial audio capture and binaural head-tracked playback over headphones with hrtf cues. In 119*th AES Convention.*

[11] Funkhouser, T., Tsingos, N., and Jot, J.-M. 2003. Survey of methods for modeling sound propagation in interactive virtual environment systems. *Presence and Teleoperation.*

[12] Giron, F. 1996. *Investigations about the Directivity of Sound Sources: Dissertation*. Berichte aus der Elektrotechnik. Shaker.

[13] Green, R. 2003. Spherical Harmonic Lighting: The Gritty Details. *Archives of the Game Developers Conference* (March).

[14] Hacihabiboglu, H., Gunel, B., and Kondoz, A. 2008. Time-domain simulation of directive sources in 3-d digital waveguide mesh-based acoustical models. *Audio, Speech, and Language Processing, IEEE Transactions on* 16, 5, 934-946.

[15] Hobson, E. W. 1955. *The Theory, of Spherical and Ellipsoidal Harmonics*. Cambridge University Press, New York, N.Y., USA.

[16] Iasig, 1999. Interactive audio special interest group: Interactive 3d audio rendering guidelines, level 2.0.

[17] James, D. L., Barbie, J., and Pal D. K. 2006. Precomputed acoustic transfer: output-sensitive, accurate sound generation for geometrically complex vibration sources. In *ACM SIG GRAPH* 2006 *Papers*, ACM, New York, N.Y., USA, SIGGRAPH '06, 987-995.

[18] Jers, H. 2005. Directivity of singers. *The Journal of the Acoustical Society of America* 118, 3, 2008-2008.

[19] Kino, G. 1987. *Acoustic waves: devices, imaging, and analog signal processing*. Prentice-Hall Signal Processing Series. Prentice Hall PTR.

[20] Liu, Y. 2009. *Fast Multipole Boundary Element Method: Theory and Applications in Engineering*. Cambridge University Press.

[21] Malham, D. G. 1999. Higher order ambisonic systems for the spatialization of sound. *ICMC Proceedings.*

[22] Mehra, R., Raghuvanshi, N., Antani, L., Chandak, A., Curtis, S., and Manocha, D. 2013. Wave-based sound propagation in large open scenes using an equivalent source formulation, *ACM Trans, Graph.* 32, 2 (April), 19:1-19:13.

[23] Menzies, Dylan; Al-Akaidi, M. 2007. Ambisonic synthesis of complex sources. *J. Audio Eng. Soc* 55, 10, 864-876.

[24] Meyer, J., and Elko, G. 2002. A highly scalable spherical microphone array based on an orthonormal decomposition of the soundfield. In *ICASSP, vol.* 2, 11-1781-11-1784.

[25] Meyer, J., and Hansen, U. 2009. *Acoustics and the Performance of Music* (*Fifth edition*). Lecture Notes in Mathematics. Springer.

[26] Ochmann, M. 1995. The source simulation technique for acoustic radiation problems. *Acustica* 81, 512-527.

[27] Otondo, F., and Rindel, J. H. 2004. The influence of the directivity of musical instruments in a room. *Acta Acustica* 90, 6, 1178-1184.

[28] Pelzer, S., Pollow, M., and Vorlander, M. 2012. Auralization of a virtual orchestra using directivities of measured symphonic instruments. *Proceedings of the Acoustics* 2012 Nantes Conference.

[29] Pierce, A. D. 1989. *Acoustics: An Introduction to Its Physical Principles and Applications*. Acoustical Society of America.

[30] Pietrzko, S., and Hofmann, R. 1996. Mathematical modelling of aircraft noise based on identified directivity patterns. In *Proc. 2nd AIAA/CEAS Areoaoustics Conference*.

[31] PTB. 1978. (last viewed Oct. 23, 2012).

[32] Rafaely, B., and Avni, A. 2010. Interaural cross correlation in a sound field represented by spherical harmonics. *The Journal of the Acoustical Society of America* 127, 2, 823-828.

[33] Raghuvanshi, N., Snyder, J., Mehra, R., Lin, M. C., and Govin-Daraju, N. K. 2010. Precomputed Wave Simulation for Real-Time Sound Propagation of Dynamic Sources in Complex Scenes. *SIGGRAPH* 2010 29, 3 (July).

[34] Sakamoto, S., Ushiyama, A., and Nagatomo, H. 2006. Numerical analysis of sound propagation in rooms using the finite difference time domain method, *The Journal of the Acoustical Society of America* 120, 5, 3008.

[35] Siltanen, S., Lokki, T., Kiminki, S., and Saviota, L. 2007. The room acoustic rendering equation. *The Journal of the Acoustical Society of America* 122, 3 (September), 1624-1635.

[36] Southern, A., and Murphy, D. 2009. Low complexity directional sound sources for finite difference time domain room acoustic models. In *Audio Engineering Society Convention* 126.

[37] Svensson, U. P., Fred, R. I., and Vanderkooy, J. 1999. An analytic secondary source model of edge diffraction impulse responses. *Acoustical Society of America Journal* 106 (November), 2331-2344.

[38] Thompson, L. L. 2006. A review of finite-element methods for time-harmonic acoustics. *The Journal of the Acoustical Society of America* 119, 3, 1315-1330.

[39] Tsingos, N., Funkhouser, T., Ngan, A., and Carlbom, I. 2001. Modeling acoustics in virtual environments using the uniform theory of diffraction. In *SIGGRAPH* '01, ACM, New York, N.Y., USA, 545-552.

[40] Tsingos, N., Dachsbacher, C., Lefebvre, S., and Dellepiane, M. 2007. Instant Sound Scattering. In Rendering Techniques (*Proceedings of the Eurographics Symposium on Rendering*).

[41] Vigeant, M. C. 2008. Investigations of incorporating source directivity into room acoustics computer models to improve auralizations. *The Journal of the Acoustical Society of America* 124, 5, 2664-2664.

[42] Vorlander, M. 1989. Simulation of the transient and steady-state sound propagation in rooms using a new combined ray-tracing/image-source algorithm. *The Journal of the Acoustical Society of America* 86, 1, 172-178.

[43] Ward, D. B., and Abhayapala, T. 2001. Reproduction of a plane-wave sound field using an array of loudspeakers. *IEEE Transactions on Speech and Audio Processing* 9, 6, 697-707.

[44] Zheng, C., and James, D. L. 2009. Harmonic fluids. In *ACM SIGGRAPH* 2009 papers, ACM, New York, N.Y., USA, 37:1-37:12.

[45] Zheng, C., and James, D. L. 2010. Rigid-body fracture sound with pre-computed soundbanks, In *ACM SIGGRAPH* 2010 *papers*, ACM, New York, N.Y., USA, 69:1-69:13.

[46] Zotkin, D. N., Duraiswami, R., and Gumerov, N. A. 2010. Plane-wave decomposition of acoustical scenes via spherical and cylindrical microphone arrays. *IEEE Trans. Audio, Speech and Language Processing* 18, 1, 2-16.

It will be understood that various details of the subject matter described herein may be changed without departing from the scope of the subject matter described herein. Furthermore, the foregoing description is for the purpose of illustration only, and not for the purpose of limitation, as the subject matter described herein is defined by the claims as set forth hereinafter.

What is claimed is:

1. A method for supporting source or listener directivity in a wave-based sound propagation model, the method comprising:

at a sound propagation model (SPM) module comprising executable instructions executable by at least one processor:

computing, prior to run-time, one or more sound fields associated with a source or listener position in a virtual environment; and modeling, at run-time and using the one or more sound fields and a wave-based sound propagation model, source or listener directivity in the virtual environment, wherein modeling, at run-time and using the one or more sound fields and the wave-based sound propagation model, source or listener directivity in the virtual environment includes:

performing a spherical harmonic (SH) decomposition of the source directivity;

computing one or more SH coefficients corresponding to the SH decomposition; and computing an acoustic response of the virtual environment, wherein the acoustic response is computed as a summation of the one or more sound fields evaluated at the listener position weighted by the one or more SH coefficients.

2. The method of claim 1 wherein the one or more sound fields are associated with one or more elemental spherical harmonics sources located at the source position.

3. The method of claim 1 wherein the one or more sound fields represent one or more acoustic responses of the environment to any directivity at the source position.

4. The method of claim 1 wherein the wave-based sound propagation model may use a finite element method, a boundary element method, an equivalent source method, a spectral method, or a frequency-domain wave-based sound propagation technique.

5. The method of claim 1 wherein computing, prior to run-time, one or more sound fields associated with a source position includes using a one-point multipole method to represent a sound field radiated by a directional source and capturing directivity using spherical harmonic (SH) expansion.

6. The method of claim 1 wherein modeling, at run-time and using the one or more sound fields and the wave-based sound propagation model, source or listener directivity in the virtual environment includes generating, using the one or more sound fields, an acoustic response to an arbitrary time-varying or rotating directional source.

7. The method of claim 1 wherein computing an acoustic response includes convolving the acoustic response with source audio information to render the sound.

8. The method of claim 1 wherein acoustic responses for both ears are computed using a head-related transfer function (HRTF).

9. The method of claim 1 wherein computing, prior to run-time, one or more sound fields associated with a source or listener position includes computing a pressure field of an entire domain by using pressure and its higher order derivatives at a single point.

10. The method of claim 1 wherein computing, prior to run-time, one or more sound fields associated with a source or listener position includes computing a plane wave decomposition of a sound field around the listener position using pressure derivatives and spherical harmonic (SH) decomposition.

11. The method of claim 10 wherein modeling, at run-time and using the one or more sound fields and the wave-based sound propagation model, source or listener directivity in the virtual environment includes computing, during run-time, spatial sound as a dot product of spherical harmonic (SH) coefficients associated with the sound field around the listener position and a head-related transfer function.

12. A system for supporting source or listener directivity in a wave-based sound propagation model, the system comprising:

at least one processor; and a sound propagation model (SPM) module comprising executable instructions executable by the at least one processor, the SPM module configured to compute, prior to run-time, one or more sound fields associated with a source or listener position and to render, at run-time and using the one or more sound fields and the wave-based sound propagation model, source or listener directivity in a virtual environment, wherein the SPM module is configured to:

perform a spherical harmonic (SH) decomposition of the source's directivity;

compute SH coefficients corresponding to the SH decomposition; and compute an acoustic response of the virtual environment to the source, wherein the acoustic response is computed as a linear combination of the one or more sound fields, wherein the one or more sound fields correspond to elementary SH sources weighted by the computed SH coefficients.

13. The system of claim 12 wherein the one or more sound fields are associated with one or more elemental spherical harmonics sources located at the source position.

14. The system of claim 12 wherein the one or more sound fields represent one or more acoustic responses of the virtual environment to any directivity at the source position.

15. The system of claim 12 wherein the wave-based sound propagation model may use a finite element method, a boundary element method, an equivalent source method, a spectral method, or a frequency-domain wave-based sound propagation technique.

16. The system of claim 12 wherein the SPM module is configured to use a one-point multipole method to represent a sound field radiated by a directional source and to capture directivity using spherical harmonic (SH) expansion.

17. The system of claim 12 wherein the SPM module is configured to generate, using the one or more sound fields, an acoustic response to an arbitrary time-varying or rotating directional source.

18. The system of claim 12 wherein the SPM module is configured to convolve the acoustic response with source audio information to render the sound.

19. The system of claim 12 wherein acoustic responses for both ears are computed using a head-related transfer function (HRTF).

20. The system of claim 12 wherein the SPM module is configured to compute a pressure field of an entire domain by using pressure and its higher order derivatives at a single point.

21. The system of claim 12 the SPM module is configured to compute a plane wave decomposition of a sound field around the listener position using pressure derivatives and spherical harmonic (SH) decomposition.

22. The system of claim 21 wherein the SPM module is configured to compute, during run-time, spatial sound as a dot product of spherical harmonic (SH) coefficients associated with the sound field around the listener position and a head-related transfer function.

23. A non-transitory computer readable medium having stored thereon executable instructions that when executed by at least one processor of a computer control the computer to perform steps comprising:

computing, prior to run-time, one or more sound fields associated with a source or listener position in a virtual environment; and modeling, at run-time and using the one or more sound fields and a wave-based sound propagation model, source or listener directivity in the virtual environment, wherein modeling, at run-time and using the one or more sound fields and the wave-based sound propagation model, source or listener directivity in the virtual environment includes:

performing a spherical harmonic (SH) decomposition of the source directivity;

computing one or more SH coefficients corresponding to the SH decomposition; and computing an acoustic response of the virtual environment, wherein the acoustic response is computed as a summation of the one or more sound fields evaluated at the listener position weighted by the one or more SH coefficients.

* * * * *